US007894991B2

(12) United States Patent
Del Castillo et al.

(10) Patent No.: US 7,894,991 B2
(45) Date of Patent: Feb. 22, 2011

(54) STATISTICAL DETERMINATION OF HISTORICAL OILFIELD DATA

(75) Inventors: Yanil Del Castillo, Sugar Land, TX (US); Joo Sitt Tan, Cypress, TX (US); Richard Reese, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 123 days.

(21) Appl. No.: 12/361,623

(22) Filed: Jan. 29, 2009

(65) Prior Publication Data

US 2009/0194274 A1 Aug. 6, 2009

Related U.S. Application Data

(60) Provisional application No. 61/025,554, filed on Feb. 1, 2008.

(51) Int. Cl.
*E21B 47/00* (2006.01)

(52) U.S. Cl. ..... 702/9; 702/11; 702/12; 702/13; 702/14; 166/313; 166/369; 166/250.01; 166/250.15; 703/10

(58) Field of Classification Search ..... 702/9, 702/11, 12, 13, 14; 166/372, 313, 369, 250.15, 166/250.01, 250.02, 250.03, 252.2, 264, 166/245, 250.16, 150, 151; 703/2, 10
See application file for complete search history.

(56) References Cited

U.S. PATENT DOCUMENTS 4,633,954 A * 1/1987 Dixon et al. ..... 166/372
4,969,130 A * 11/1990 Wason et al. ..... 367/73
5,305,209 A * 4/1994 Stein et al. ..... 702/13
5,444,619 A * 8/1995 Hoskins et al. ..... 702/13
5,706,896 A * 1/1998 Tubel et al. ..... 166/313
5,732,776 A * 3/1998 Tubel et al. ..... 166/250.15
5,764,515 A * 6/1998 Guerillot et al. ..... 702/2
5,975,204 A * 11/1999 Tubel et al. ..... 166/250.15
5,992,519 A * 11/1999 Ramakrishnan et al. ..... 166/250.15
6,266,619 B1 * 7/2001 Thomas et al. ..... 702/13
6,356,844 B2 * 3/2002 Thomas et al. ..... 702/12
6,549,879 B1 * 4/2003 Cullick et al. ..... 703/10
2005/0149307 A1 7/2005 Gurpinar
2007/0199721 A1 * 8/2007 Givens et al. ..... 166/382

* cited by examiner

*Primary Examiner*—Carol S Tsai
(74) *Attorney, Agent, or Firm*—Robert P. Lord; Cuong L. Nguyen; Bryan P. Galloway

(57) ABSTRACT

A method, system, and computer program product for performing oilfield surveillance operations. The oilfield has a subterranean formation with geological structures and reservoirs therein. The oilfield is divided into a plurality of patterns, with each pattern comprising a plurality of wells. Historical production/injection data is obtained for the plurality of wells. Two independent statistical treatments are performed to achieve a common objective of production optimization. In the first process, wells and/or patterns are characterized based on Heterogeneity Index results and personalities with the ultimate goal of field production optimization. In the second process, the history of the flood is divided into even time increments. At least two domains for each of the plurality of wells are determined. Each of the at least two domains are centered around each of the plurality wells. A first domain of the at least two domains has a first orientation. A second domain of the at least two domains has a second orientation. An Oil Processing Ratio is determined for each of the at least two domains, then an Oil Processing Ratio Strength Indicator is calculated. At least one Meta Pattern within the field is then identified. An oilfield operation can then be guided based either on the well and/or pattern personality or the at least one Meta Pattern.

24 Claims, 31 Drawing Sheets

| 3 VARIABLES - $q_o$, $q_w$, $i_w$ | | | | | |
|---|---|---|---|---|---|
| $q_o$ | $q_w$ | $i_w$ | CODE | PATTERN PERSONALITIES | |
| LO | LO | LO | 000 | LAZY | 910 |
| LO | LO | HI | 001 | WASTER | 912 |
| LO | HI | LO | 010 | THIEF | 914 |
| LO | HI | HI | 011 | SHORT CUTTER | 916 |
| HI | LO | LO | 100 | PERFECT | 918 |
| HI | LO | HI | 101 | HARD WORKING | 920 |
| HI | HI | LO | 110 | CELEBRITY | 922 |
| HI | HI | HI | 111 | HYPERACTIVE | 924 |

*FIG. 9*

5 PARAMETERS ($q_o$, $q_w$, $q_g$, $i_w$, $i_g$)

| 1010 $q_o$ | 1012 $q_w$ | 1014 $q_g$ | 1016 $i_w$ | 1018 $i_g$ | CODE | DESCRIPTION | 1010 $q_o$ | 1012 $q_w$ | 1014 $q_g$ | 1016 $i_w$ | 1018 $i_g$ | CODE | DESCRIPTION |
|---|---|---|---|---|---|---|---|---|---|---|---|---|---|
| LO | LO | LO | LO | LO | 00000 | LAZY | HI | LO | LO | LO | LO | 10000 | PERFECT |
| LO | LO | LO | LO | HI | 00001 | GAS WASTER | HI | LO | LO | LO | HI | 10001 | GAS HARDWORKING |
| LO | LO | LO | HI | LO | 00010 | WATER WASTER | HI | LO | LO | HI | LO | 10010 | WATER HARDWORKING |
| LO | LO | LO | HI | HI | 00011 | DUAL WASTER | HI | LO | LO | HI | HI | 10011 | DUAL HARDWORKING |
| LO | LO | HI | LO | LO | 00100 | GAS THIEF | HI | LO | HI | LO | LO | 10100 | GAS CELEBRITY |
| HI | LO | HI | LO | HI | 00101 | GAS SHORTCUTTER | HI | LO | HI | LO | HI | 10101 | GAS HYPERACTIVE GINJ PUSH |
| LO | LO | HI | HI | LO | 00110 | WINJ PUSH GAS | HI | LO | HI | HI | LO | 10110 | GAS HYPERACTIVE WINJ PUSH |
| LO | LO | HI | HI | HI | 00111 | DUAL PUSH GAS | HI | LO | HI | HI | HI | 10111 | GAS HYPERACTIVE DUAL PUSH |
| LO | HI | LO | LO | LO | 01000 | WATER THIEF | HI | HI | LO | LO | LO | 11000 | WATER CELEBRITY |
| LO | HI | LO | LO | HI | 01001 | GINJ PUSH WATER | HI | HI | LO | LO | HI | 11001 | WATER HYPERACTIVE GINJ PUSH |
| LO | HI | LO | HI | LO | 01010 | WATER SHORTCUTTER | HI | HI | LO | HI | LO | 11010 | WATER HYPERACTIVE WINJ PUSH |
| LO | HI | LO | HI | HI | 01011 | DUAL PUSH WATER | HI | HI | LO | HI | HI | 11011 | WATER HYPERACTIVE DUAL PUSH |
| LO | HI | HI | LO | LO | 01100 | DUAL THIEF | HI | HI | HI | LO | LO | 11100 | DUAL CELEBRITY |
| LO | HI | HI | LO | HI | 01101 | GAS SHORTCUTTER + WATER | HI | HI | HI | LO | HI | 11101 | DUAL HYPERACTIVE GINJ PUSH |
| LO | HI | HI | HI | LO | 01110 | WATER SHORTCUTTER + GAS | HI | HI | HI | HI | LO | 11110 | DUAL HYPERACTIVE WINJ PUSH |
| LO | HI | HI | HI | HI | 01111 | DUAL SHORTCUTTER | HI | HI | HI | HI | HI | 11111 | EXTREME HYPERACTIVE |

*FIG. 10*

1112 1114

| 3 VARIABLES - $q_o$, $q_w$, $q_g$ | | | | | |
|---|---|---|---|---|---|
| 1110 $q_o$ | $q_w$ | $q_g$ | CODE | PRODUCER PERSONALITIES | |
| LO | LO | LO | 000 | LAZY | 1118 |
| LO | LO | HI | 001 | LAG HIGH GAS | 1120 |
| LO | HI | LO | 010 | LAG HIGH WATER | 1122 |
| LO | HI | HI | 011 | TROUBLESOME | 1124 |
| HI | LO | LO | 100 | PERFECT | 1128 |
| HI | LO | HI | 101 | LEAD HIGH GAS | 1130 |
| HI | HI | LO | 110 | LEAD HIGH WATER | 1132 |
| HI | HI | HI | 111 | HYPERACTIVE | 1134 |

1116 1126

*FIG. 11*

| 2 VARIABLES - $i_w$, $i_g$ 1212 | | | |
|---|---|---|---|
| 1210 $i_w$ | $i_g$ | CODE | INJECTOR PERSONALITIES 1214 |
| LO | LO | 00 | WEAK INJECTOR OR LAG GINJ OR LAG WINJ |
| LO | HI | 01 | LEAD GINJ OR LAG WINJ LEAD GINJ |
| HI | LO | 10 | LEAD WINJ OR LEAD WINJ LAG GINJ |
| HI | HI | 11 | STRONG INJECTOR |

*FIG. 12*

DOMAIN 1610

Microsoft Access - [OFM_DATA_Pattern : Table]

File Edit View Insert Format Records Tools

| PATTERNSET | PATTERNNAME | DATE | WELL | FACTOR | LOSS |
|---|---|---|---|---|---|
| MDA_CASE_2B | MP374 | 1/2/1900 | 1892432 | 1 | |
| MDA_CASE_2B | MP360 | 1/2/1900 | 1892432 | 1 | |
| MDA_CASE_2B | MP359 | 1/2/1900 | 1892432 | 1 | |
| MDA_CASE_2B | MP25 | 1/2/1900 | 1892432 | 1 | |
| MDA_CASE_2B | MP163 | 1/2/1900 | 1892432 | 1 | |
| MDA_CASE_2B | MP51 | 1/2/1900 | 1892431 | 1 | |
| MDA_CASE_2B | MP386 | 1/2/1900 | 1892431 | 1 | |
| MDA_CASE_2B | MP385 | 1/2/1900 | 1892431 | 1 | |
| MDA_CASE_2B | MP361 | 1/2/1900 | 1892431 | 1 | |
| MDA_CASE_2B | MP360 | 1/2/1900 | 1892431 | 1 | |
| MDA_CASE_2B | MP163 | 1/2/1900 | 1892431 | 1 | |
| MDA_CASE_2B | MP384 | 1/2/1900 | 1892430 | 1 | |
| MDA_CASE_2B | MP382 | 1/2/1900 | 1892430 | 1 | |
| MDA_CASE_2B | MP381 | 1/2/1900 | 1892430 | 1 | |
| MDA_CASE_2B | MP164 | 1/2/1900 | 1892430 | 1 | |
| MDA_CASE_2B | MP383 | 1/2/1900 | 1892429 | 1 | |
| MDA_CASE_2B | MP377 | 1/2/1900 | 1892429 | 1 | |
| MDA_CASE_2B | MP384 | 1/2/1900 | 1892428 | 1 | |
| MDA_CASE_2B | MP382 | 1/2/1900 | 1892428 | 1 | |
| MDA_CASE_2B | MP381 | 1/2/1900 | 1892428 | 1 | |
| MDA_CASE_2B | MP379 | 1/2/1900 | 1892428 | 1 | |
| MDA_CASE_2B | MP378 | 1/2/1900 | 1892428 | 1 | |
| MDA_CASE_2B | MP384 | 1/2/1900 | 1892427 | 1 | |
| MDA_CASE_2B | MP382 | 1/2/1900 | 1892427 | 1 | |

Record: 26621 OF 42268

Datasheet View

DOMAIN 1620

Microsoft Access - [OFM_DATA_Pattern : Table]

File Edit View Insert Format Records Tools

| PATTERNSET | PATTERNNAME | DATE | WELL | FACTOR | LOSS |
|---|---|---|---|---|---|
| MDA_CASE_2D | MP217 | 1/2/1900 | 1892140 | 1 | |
| MDA_CASE_2D | MP208 | 1/2/1900 | 1892140 | 1 | |
| MDA_CASE_2D | MP207 | 1/2/1900 | 1892140 | 1 | |
| MDA_CASE_2D | MP206 | 1/2/1900 | 1892140 | 1 | |
| MDA_CASE_2D | MP169 | 1/2/1900 | 1892140 | 1 | |
| MDA_CASE_2D | MP127 | 1/2/1900 | 1892140 | 1 | |
| MDA_CASE_2D | MP121 | 1/2/1900 | 1892140 | 1 | |
| MDA_CASE_2D | MP61 | 1/2/1900 | 1892139 | 1 | |
| MDA_CASE_2D | MP59 | 1/2/1900 | 1892139 | 1 | |
| MDA_CASE_2D | MP58 | 1/2/1900 | 1892139 | 1 | |
| MDA_CASE_2D | MP48 | 1/2/1900 | 1892139 | 1 | |
| MDA_CASE_2D | MP46 | 1/2/1900 | 1892139 | 1 | |
| MDA_CASE_2D | MP44 | 1/2/1900 | 1892139 | 1 | |
| MDA_CASE_2D | MP39 | 1/2/1900 | 1892139 | 1 | |
| MDA_CASE_2D | MP271 | 1/2/1900 | 1892139 | 1 | |
| MDA_CASE_2D | MP270 | 1/2/1900 | 1892139 | 1 | |
| MDA_CASE_2D | MP191 | 1/2/1900 | 1892139 | 1 | |
| MDA_CASE_2D | MP190 | 1/2/1900 | 1892139 | 1 | |
| MDA_CASE_2D | MP176 | 1/2/1900 | 1892139 | 1 | |
| MDA_CASE_2D | MP175 | 1/2/1900 | 1892139 | 1 | |
| MDA_CASE_2D | MP174 | 1/2/1900 | 1892139 | 1 | |
| MDA_CASE_2D | MP167 | 1/2/1900 | 1892139 | 1 | |
| MDA_CASE_2D | MP120 | 1/2/1900 | 1892139 | 1 | |
| MDA_CASE_2D | MP66 | 1/2/1900 | 1892138 | 1 | |

Record: 26621 OF 42268

Datasheet View

SAME WELL BELONG TO DIFFERENT PATTERNS (OVERLAPPING)
WELLS CONTAINED IN EACH PATTERN DO NOT VARY WITH TIME

*FIG. 16*

DOMAIN 1710 | OIL PRODUCTION 1712 | WATER PRODUCTION 1714 | GAS PRODUCTION 1716 | TOTAL FLUID PRODUCTION 1718 | GAS INJECTION 1720 | CO2 INJECTION 1722 | WATER INJECTION 1724 | TOTAL FLUID INJECTION 1726 | OIL PROCESSING RATIO 1728 | VOIDAGE REPLACEMENT RATIO 1730

| | Date | @LOADNAME () | MDA_MONTHLY_OIL_RES_FINAL | MDA_MONTHLY_WATER_RES_FINAL | MDA_MONTHLY_GAS_RES_FINAL | MDA_MONTHLY_PRODFLUID_RES_FINAL | MDA_MONTHLY_GASINJ_RES_FINAL | MDA_MONTHLY_CINJ_RES_FINAL | MDA_MONTHLY_WINJ_RES_FINAL | MDA_MONTHLY_INJ_FLUID_RES_FINAL | MDA_OPR_RES_FINAL | MDA_VRR_RES_FINAL | "CASE_2B" | "45" |
|---|---|---|---|---|---|---|---|---|---|---|---|---|---|---|
| 1 | 12/1/1970 | PATTERN: MP1 | 146728.26 | 41651.85 | 5466.14 | 193846.24 | 0.00 | 0.00 | 4331352.63 | 4331352.63 | 3.387585 | 22.344269 | CASE_2B | 45 |
| 2 | 12/1/1975 | PATTERN: MP1 | 1125177.48 | 474160.23 | 145229.27 | 1744566.98 | 0.00 | 0.00 | 5042112.34 | 5042112.34 | 22.315597 | 2.890180 | CASE_2B | 45 |
| 3 | 12/1/1980 | PATTERN: MP1 | 677272.43 | 442788.28 | 38816.86 | 1158877.57 | 0.00 | 0.00 | 3349927.22 | 3349927.22 | 20.217527 | 2.690665 | CASE_2B | 45 |
| 4 | 12/1/1985 | PATTERN: MP1 | 419971.23 | 600008.89 | 13836.47 | 1033816.59 | 0.00 | 0.00 | 3416906.77 | 3416906.77 | 12.290977 | 3.305138 | CASE_2B | 45 |
| 5 | 12/1/1990 | PATTERN: MP1 | 338647.55 | 582178.47 | 20568.26 | 941394.28 | 0.00 | 861959.72 | 2376583.51 | 3228543.23 | 10.489176 | 3.429533 | CASE_2B | 45 |
| 6 | 12/1/1995 | PATTERN: MP1 | 242800.74 | 506006.94 | 0.00 | 748807.68 | 0.00 | 1305814.09 | 627364.47 | 1933178.57 | 12.559664 | 2.581676 | CASE_2B | 45 |
| 7 | 12/1/2000 | PATTERN: MP1 | 213079.04 | 331781.01 | 176.83 | 545036.88 | 0.00 | 0.00 | 1183290.02 | 1183290.02 | 18.007339 | 2.171027 | CASE_2B | 45 |
| 8 | 12/1/2005 | PATTERN: MP1 | 153629.44 | 206633.22 | 14959.09 | 375221.75 | 0.00 | 0.00 | 798685.48 | 798685.48 | 19.235287 | 2.128569 | CASE_2B | 45 |
| 9 | 12/1/1965 | PATTERN: MP10 | 87757.99 | 766.44 | 500470.26 | 588994.69 | 0.00 | 0.00 | 753568.68 | 753568.68 | 11.645653 | 1.279415 | CASE_2B | 45 |
| 10 | 12/1/1970 | PATTERN: MP10 | 488642.87 | 296320.20 | 43697.27 | 828660.34 | 0.00 | 0.00 | 4988164.43 | 4988164.43 | | | | |
| 11 | 12/1/1975 | PATTERN: MP10 | 1184435.78 | 1235161.49 | 6506.91 | 2426124.18 | 0.00 | 0.00 | 3745519.72 | 3745519.72 | | | | |
| 12 | 12/1/1980 | PATTERN: MP10 | 557247.60 | 652973.85 | 59828.21 | 1170049.66 | 0.00 | 0.00 | 2103959.13 | 2103959.13 | | | | |
| 13 | 12/1/1985 | PATTERN: MP10 | 380295.97 | 518660.68 | 36410.58 | 935367.24 | 0.00 | 0.00 | 2290316.23 | 2290316.23 | | | | |
| 14 | 12/1/1990 | PATTERN: MP10 | 253442.20 | 827849.65 | 35125.16 | 1116417.01 | 0.00 | 672118.98 | 1085836.06 | 1757955.04 | | | | |
| 15 | 12/1/1995 | PATTERN: MP10 | 198905.87 | 665717.43 | 324.37 | 864947.66 | 0.00 | 878366.28 | 351521.04 | 1229887.32 | | | | |
| 16 | 12/1/2000 | PATTERN: MP10 | 104266.12 | 451583.83 | 157.96 | 556007.92 | 0.00 | 0.00 | 724363.44 | 724363.44 | | | | |

VALUES FOR EACH TIME PERIOD

STEP

PATTERN: MDA_CASE_2B

MP1

MP10

MP100

ANGLE SELECTION

1700

*FIG. 17*

DOMAIN 1810

WELL CENTER 1830

PRODUCTION AND INJECTION VALUES 1820

| Date | MP | WHNM | CumOil | CumWater | CumGas | CumProdFluid | CumGINJ | CumCINJ | CumWINJ | CumInjFluid | OPR | VRR | CASE | OPRANGLE | Ocut | Wcut |
|---|---|---|---|---|---|---|---|---|---|---|---|---|---|---|---|---|
| 12/1/1985 | PATTERN: MP294 | 100 | 242204.256 | 2054842.988 | 13191.29961 | 2310238.543859 | 0 | 0 | 3073131.052 | 3073131.052 | 7.881351361 | 1.330222396 | CASE_2B | 45 | 0.105441564 | 0.894558435 |
| 12/1/1985 | PATTERN: MP293 | 99 | 209311.452 | 2159444.184 | 11430.19311 | 2380185.62971 | 0 | 0 | 2281612.863 | 2281612.863 | 9.173837303 | 0.958586020 | CASE_2B | 45 | 0.088363463 | 0.911636536 |
| 12/1/1985 | PATTERN: MP292 | 98 | 207084.276 | 2064849.310 | 11314.04751 | 2263247.634041 | 0 | 0 | 1682553.51 | 1682553.51 | 12.30773789 | 0.736912407 | CASE_2B | 45 | 0.091148912 | 0.908851087 |
| 12/1/1985 | PATTERN: MP304 | 110 | 429436.726 | 931521.5401 | 42421.45846 | 1403379.726606 | 0 | 0 | 1216618.693 | 1216618.693 | 35.29756119 | 0.866920528 | CASE_2B | 45 | 0.315539967 | 0.664460032 |
| 12/1/1985 | PATTERN: MP87 | 308 | 446431.986 | 878606.1918 | 42496.95054 | 1367535.128398 | 0 | 0 | 2576245.829 | 2576245.829 | 17.32878054 | 1.883860806 | CASE_2B | 45 | 0.336920092 | 0.663079907 |
| 12/1/1985 | PATTERN: MP74 | 296 | 653589.972 | 1153741.732 | 21448.86787 | 1828780.572194 | 0 | 0 | 4621794.647 | 4621794.647 | 14.14147580 | 2.527254892 | CASE_2B | 45 | 0.361632549 | 0.638367450 |
| 12/1/1990 | PATTERN: MP1 | 357 | 338647.554 | 582178.4749 | 20568.25584 | 941394.2848233 | 0 | 85969.7249 | 2376583.506 | 3226543.231 | 10.48917513 | 3.429533494 | CASE_2B | 45 | 0.367764966 | 0.632235033 |
| 12/1/1985 | PATTERN: MP99 | 320 | 93632.112 | 1070904.286 | 5496.855835 | 1170033.254755 | 0 | 0 | 2296832.053 | 2296832.053 | 4.076576336 | 1.963048524 | CASE_2B | 45 | 0.080402907 | 0.919597092 |
| 12/1/1985 | PATTERN: MP98 | 319 | 539340.606 | 939422.2767 | 52496.00863 | 1531257.891567 | 0 | 0 | 1018499.899 | 1018499.899 | 52.95440933 | 0.665139363 | CASE_2B | 45 | 0.364724197 | 0.635275802 |
| 12/1/1985 | PATTERN: MP97 | 318 | 546597.072 | 2169150.317 | 38228.08306 | 2753975.472268 | 0 | 0 | 3292814.535 | 3292814.535 | 16.59969203 | 1.195658628 | CASE_2B | 45 | 0.201269482 | 0.798730517 |
| 12/1/1985 | PATTERN: MP96 | 317 | 481539.492 | 3569144.447 | 13204.32465 | 4063888.263858 | 0 | 0 | 3935243.844 | 3935243.844 | 12.23658566 | 0.968344498 | CASE_2B | 45 | 0.118878564 | 0.881121435 |
| 12/1/1985 | PATTERN: MP95 | 316 | 269492.086 | 3554768.342 | 8773.852757 | 3823034.281458 | 0 | 0 | 3685071.948 | 3685071.948 | 7.041710164 | 0.963912870 | CASE_2B | 45 | 0.068032084 | 0.931967915 |
| 12/1/1985 | PATTERN: MP94 | 315 | 648806.76 | 1625364.604 | 18114.68481 | 2292276.248982 | 0 | 0 | 3209875.961 | 3209875.961 | 20.21282964 | 1.400300667 | CASE_2B | 45 | 0.285294953 | 0.714705046 |
| 12/1/1985 | PATTERN: MP93 | 314 | 520237.242 | 2016962.671 | 14399.93496 | 2551599.848391 | 0 | 0 | 3182536.347 | 3182536.347 | 16.34662373 | 1.247270942 | CASE_2B | 45 | 0.205043851 | 0.794956148 |
| 12/1/1985 | PATTERN: MP92 | 313 | 177539.04 | 266229.9136 | 1809.973270 | 445578.9269197 | 0 | 0 | 227270.1914 | 227270.1914 | 78.11804922 | 0.510055969 | CASE_2B | 45 | 0.400070889 | 0.599929110 |
| 12/1/1985 | PATTERN: MP91 | 312 | 149424.912 | 1728498.496 | 3125.589238 | 1881048.998015 | 0 | 0 | 1506352.819 | 1506352.819 | 9.919648971 | 0.800804668 | CASE_2B | 45 | 0.079569225 | 0.920430774 |

Record 6387

1800

*FIG. 18*

COORDINATES 2010

TIME PERIODS 2020

PRODUCTION INDICATORS 2030

SPOTFIRE DATABASE

2000

Microsoft Access - [W_DatabaseforSpotfire : Table]

File Edit View Insert Format Records Tools Help

| Xnew | Ynew | Delta T | MP_OPR_45 | MP_Ocut_45 | MP_VRR_45 | MP_Wout_45 | MP_OPR_135 | MP_Ocut_135 | MP_VRR_135 | MP_Cut_135 | WELL | WNUM |
|---|---|---|---|---|---|---|---|---|---|---|---|---|
| 664200 | 658600 | Delta T5, 81-85 | 10.641467 | 0.156494 | 1.647531 | 0.843506 | 10.24307 | 0.162501 | 1.610614 | 0.837499 | | |
| 664200 | 658600 | Delta T6, 86-90 | 7.967112 | 0.093473 | 1.387597 | 0.906527 | 7.495258 | 0.107926 | 1.439646 | 0.892074 | | |
| 664200 | 658600 | Delta T7, 91-95 | 8.220719 | 0.07347 | 1.0013 | 0.92653 | 9.609812 | 0.106869 | 1.178719 | 0.893131 | | |
| 664200 | 658600 | Delta T8, 96-00 | 11.78465 | 0.142343 | 1.160968 | 0.857657 | 13.840548 | 0.143802 | 1.028414 | 0.856198 | | |
| 664200 | 658600 | Delta T9, 01-05 | 7.567162 | 0.151955 | 1.988547 | 0.848045 | 8.471381 | 0.154255 | 1.803861 | 0.845745 | | |
| 664200 | 658800 | Delta T3, 71-75 | 30.198447 | 0.474413 | 1.533855 | 0.525587 | 33.063646 | 0.541762 | 1.621084 | 0.458238 | | |
| 664200 | 658800 | Delta T4, 76-80 | 18.00631 | 0.220094 | 1.232696 | 0.779906 | 21.596272 | 0.257077 | 1.217438 | 0.742923 | | |
| 664200 | 658800 | Delta T5, 81-85 | 8.892596 | 0.145741 | 1.769813 | 0.854259 | 10.628307 | 0.159779 | 1.523477 | 0.840221 | | |
| 664200 | 658800 | Delta T6, 86-90 | 6.548511 | 0.088862 | 1.537859 | 0.911138 | 7.452222 | 0.110776 | 1.481812 | 0.889224 | | |
| 664200 | 658800 | Delta T7, 91-95 | 6.820101 | 0.06975 | 1.129984 | 0.93025 | 8.994618 | 0.111501 | 1.280196 | 0.888499 | | |
| 664200 | 658800 | Delta T8, 96-00 | 10.529706 | 0.132965 | 1.200194 | 0.867035 | 13.14432 | 0.149701 | 1.116635 | 0.850299 | | |
| 664200 | 658800 | Delta T9, 01-05 | 6.828203 | 0.139544 | 2.003942 | 0.860456 | 8.469822 | 0.156512 | 1.82811 | 0.843488 | | |
| 664200 | 659000 | Delta T3, 71-75 | 27.182186 | 0.461246 | 1.616007 | 0.538754 | 31.311595 | 0.538097 | 1.675834 | 0.461903 | | |
| 664200 | 659000 | Delta T4, 76-80 | 15.551166 | 0.20432 | 1.293856 | 0.79568 | 19.303081 | 0.245283 | 1.266726 | 0.754717 | | |
| 664200 | 659000 | Delta T5, 81-85 | 7.260603 | 0.135082 | 1.87608 | 0.864918 | 11.278348 | 0.156373 | | | | |
| 664200 | 659000 | Delta T6, 86-90 | 5.069853 | 0.083747 | 1.685992 | 0.916253 | 7.553089 | 0.114467 | | | | |
| 664200 | 659000 | Delta T7, 91-95 | 5.265609 | 0.065761 | 1.275797 | 0.934239 | 8.557082 | 0.116955 | | | | |
| 664200 | 659000 | Delta T8, 96-00 | 9.552488 | 0.124523 | 1.222021 | 0.875477 | 12.56344 | 0.155901 | | | | |
| 664200 | 659000 | Delta T9, 01-05 | 6.285283 | 0.128498 | 1.992392 | 0.871502 | 8.540899 | 0.158101 | | | | |
| 664200 | 659200 | Delta T3, 71-75 | 26.694272 | 0.459652 | 1.631965 | 0.540348 | 31.16389 | 0.538387 | | | | |
| 664200 | 659200 | Delta T4, 76-80 | 15.277784 | 0.203405 | 1.307961 | 0.796595 | 19.053175 | 0.243771 | | | | |
| 664200 | 659200 | Delta T5, 81-85 | 7.058028 | 0.134721 | 1.902092 | 0.865279 | 11.388754 | 0.156215 | | | | |
| 664200 | 659200 | Delta T6, 86-90 | 4.840241 | 0.083303 | 1.714412 | 0.916697 | 7.598119 | 0.115806 | | | | |
| 664200 | 659200 | Delta T7, 91-95 | 4.961477 | 0.06529 | 1.309832 | 0.93471 | 8.598447 | 0.118725 | | | | |

| Interval | Begin Date | End Date |
|---|---|---|
| deltaT1 | 1/1/1961 | 12/1/1965 |
| deltaT2 | 1/1/1966 | 12/1/1970 |
| deltaT3 | 1/1/1971 | 12/1/1975 |
| deltaT4 | 1/1/1976 | 12/1/1980 |
| deltaT5 | 1/1/1981 | 12/1/1985 |
| deltaT6 | 1/1/1986 | 12/1/1990 |
| deltaT7 | 1/1/1991 | 12/1/1995 |
| deltaT8 | 1/1/1996 | 12/1/2000 |
| deltaT8 | 1/1/2001 | 12/1/2005 |

*FIG. 20*

MP SCAN PLOT, FIELD LEVEL

STATISTICAL DETERMINATION OF HISTORICAL OILFIELD DATA

CROSS REFERENCE TO RELATED APPLICATION

This application claims priority, pursuant to 35 U.S.C. §119(e), to the filing date of U.S. Provisional Patent Application Ser. No. 61/025,554, entitled "Statistical Determination of Historical Oilfield Data," filed on Feb. 1, 2008, which is hereby incorporated by reference in its entirety.

FIELD OF THE INVENTION

This invention relates to a method, system, and computer program product for performing oilfield surveillance operations. In particular, the inventions provides methods and systems for more effectively and efficiently statistically analyzing historical oilfield data in order to optimize oilfield operations, including potential infill development, recompletion and stimulation.

BACKGROUND OF THE INVENTION

Extraction of oil and gas has become more troublesome. While resources remain within reservoirs, the majority of the easily extracted oil and gas has already been withdrawn from those reservoirs. In an attempt to extract more fluids from mature reservoirs, field optimization techniques are currently being implemented. Whereas some of these techniques involve adjusting various extraction related parameters in order to optimize the rates at which oil and gas is extracted from the reservoir, others are focused on more accurately selecting the well or field for which optimization effort should be focused.

SUMMARY OF THE INVENTION

In view of the above problems, an object of the present invention is to provide methods and systems for extracting useful information from production data and basic well data to characterize field and well performance for the purpose of optimizing or increasing production. The present methods and systems can also analyze fields where only production data is available. Furthermore, the present methods and systems can be used as supplemental analysis techniques in cases where optimization work is being carried out using more complete data such as seismic, geological, or pressure information.

A method for performing oilfield surveillance operations for an oilfield is described. The oilfield has a subterranean formation with geological structures and reservoirs therein. The oilfield is divided into a plurality of patterns, with each pattern comprising a plurality of wells. Historical production/injection data is obtained for the plurality of wells. Two independent statistical treatments are performed to achieve a common objective of production optimization. The first statistical process is called Performance Model. In this first process, wells and/or patterns are characterized based on Heterogeneity Index results and personalities with the ultimate goal of field production optimization. The second statistical process is called Meta Patterns and applies particularly to waterflood scenarios. In this second process, the history of the flood is divided into even time increments then the over performing areas are identified for each time interval using various production indicators. From this data, possible areas of infill potential may be approximated as well as opportunities for modifying water injection to increase recovery. An oilfield operation can then be guided based either on the well and/or pattern personality or the at least one Meta Pattern.

Other objects, features and advantages of the present invention will become apparent to those of skill in art by reference to the figures, the description that follows and the claims.

BRIEF DESCRIPTION OF THE DRAWINGS

FIG. 9 is a simplified pattern personality analysis according to an illustrative embodiment;

FIG. 10 is an expanded pattern personality analysis according to an illustrative embodiment;

FIG. 11 is an expanded personality analysis for producing wells according to an illustrative embodiment;

FIG. 12 is an expanded personality analysis for injection wells according to an illustrative embodiment;

FIG. 16 is a sample of the domains for each flood design angle, according to an illustrative embodiment;

FIG. 17 is a sample database of production/injection for various domains at the first flood design angle according to an illustrative embodiment;

FIG. 18 is a sample database correlating domains to specific domain centers according to an illustrative embodiment;

FIG. 20 is a database representing several grid maps into a unique Cartesian coordinate system according to an illustrative embodiment;

DETAILED DESCRIPTION OF THE DRAWINGS

In the following detailed description of the preferred embodiments and other embodiments of the invention, reference is made to the accompanying drawings. It is to be understood that those of skill in the art will readily see other embodiments and changes may be made without departing from the scope of the invention.

Figure 1A:
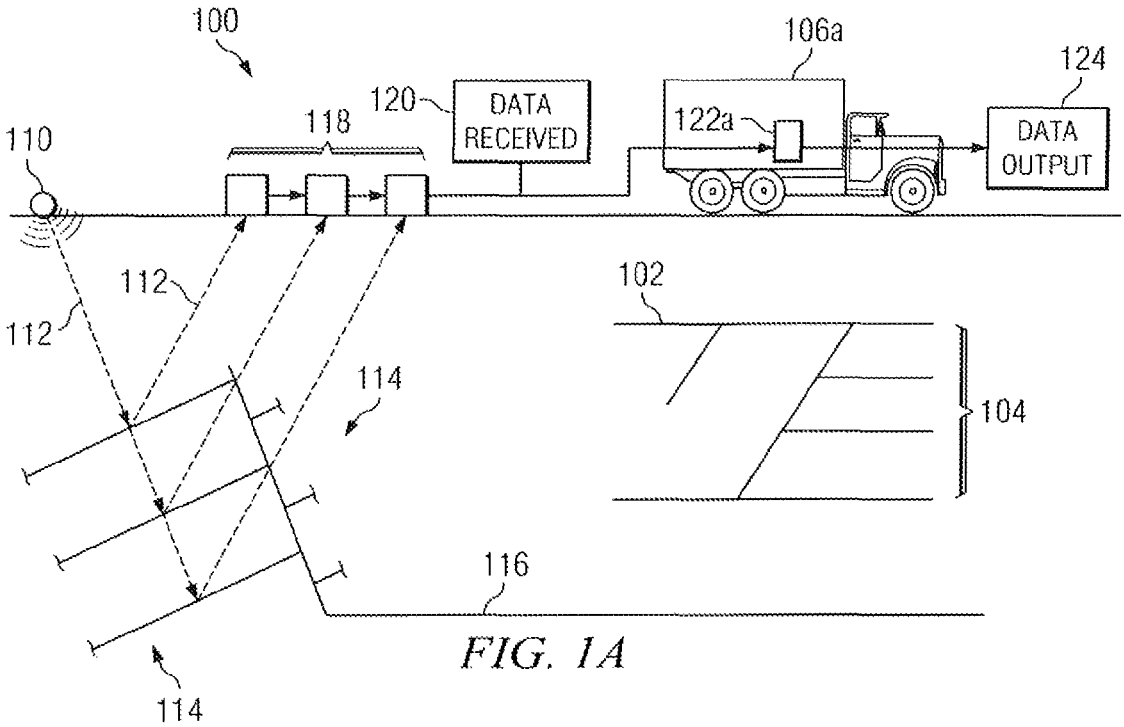
FIGS. 1A-1D are simplified representative schematic views of oilfield operations.

FIGS. 1A-1D depict simplified, representative, schematic views of oilfield 100 having subterranean formation 102 containing reservoir 104 therein and depicting various oilfield operations being performed on the oilfield. FIG. 1A depicts a survey operation being performed by a survey tool, such as seismic truck 106*a*, to measure properties of the subterranean formation. The survey operation is a seismic survey operation for producing sound vibrations. In FIG. 1A, one such sound vibration, sound vibration 112 generated by source 110, reflects off horizons 114 in earth formation 116. A set of sound vibration, such as sound vibration 112 is received in by sensors, such as geophone-receivers 118, situated on the earth's surface. In response to receiving these vibrations, geophone receivers 118 produce electrical output signals, referred to as data received 120 in FIG. 1A.

In response to the received sound vibration(s) 112 representative of different parameters (such as amplitude and/or frequency) of sound vibration(s) 112, geophones 118 produce electrical output signals containing data concerning the subterranean formation. Data received 120 is provided as input data to computer 122*a* of seismic truck 106*a*, and responsive to the input data, computer 122*a* generates seismic data output 124. This seismic data output may be stored, transmitted or further processed as desired, for example by data reduction.

Figure 1B:
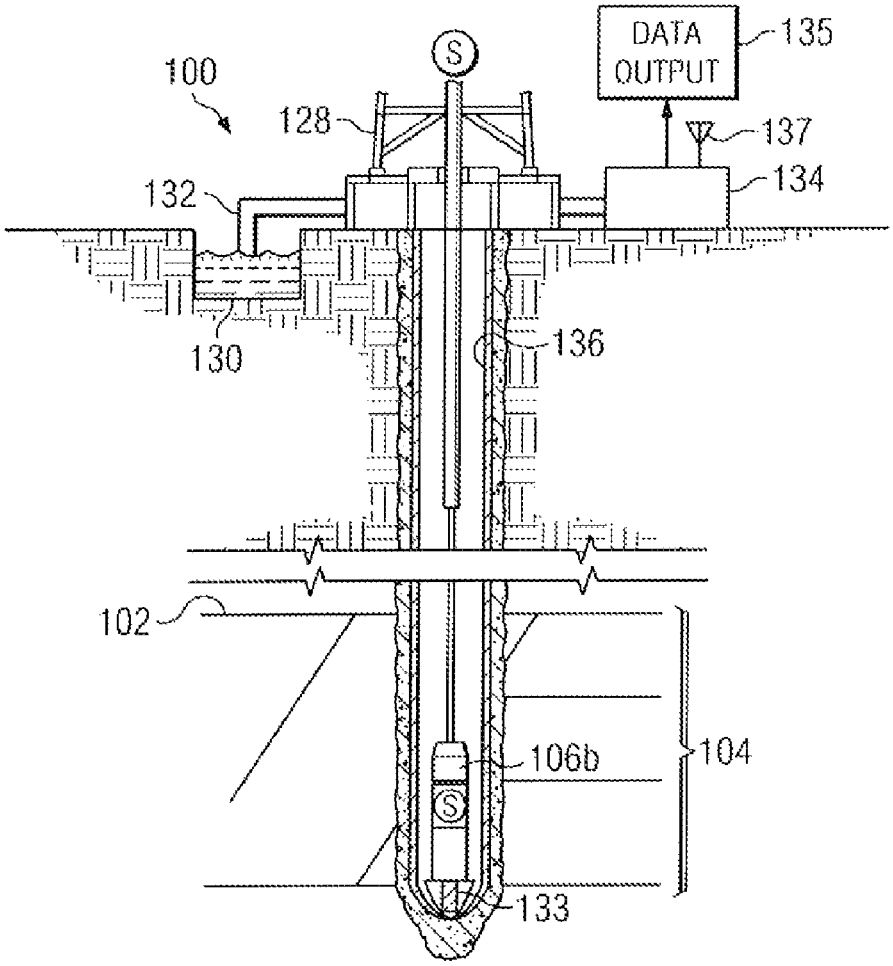

FIG. 1B depicts a drilling operation being performed by drilling tools 106*b* suspended by rig 128 and advanced into subterranean formations 102 to form wellbore 136. Mud pit 130 is used to draw drilling mud into the drilling tools via flow line 132 for circulating drilling mud through the drilling tools, up wellbore 136 and back to the surface. The drilling mud is usually filtered and returned to the mud pit. A circulating system may be used for storing, controlling, or filtering the flowing drilling muds. The drilling tools are advanced into the subterranean formations 102 to reach reservoir 104. Each well may target one or more reservoirs. The drilling tools are preferably adapted for measuring downhole properties using logging while drilling tools. The logging while drilling tool may also be adapted for taking core sample 133 as shown, or removed so that a core sample may be taken using another tool.

Surface unit 134 is used to communicate with the drilling tools and/or offsite operations. Surface unit 134 is capable of communicating with the drilling tools to send commands to the drilling tools, and to receive data therefrom. Surface unit 134 is preferably provided with computer facilities for receiving, storing, processing, and/or analyzing data from the oilfield. Surface unit 134 collects data generated during the drilling operation and produces data output 135 that may be stored or transmitted. Computer facilities, such as those of the surface unit, may be positioned at various locations about the oilfield and/or at remote locations.

Sensors S, such as gauges, may be positioned about the oilfield to collect data relating to various oilfield operations as described previously. As shown, sensor S is positioned in one or more locations in the drilling tools and/or at rig 128 to measure drilling parameters, such as weight on bit, torque on bit, pressures, temperatures, flow rates, compositions, rotary speed, and/or other parameters of the oilfield operation. Sensors S may also be positioned in one or more locations in the circulating system.

The data gathered by sensors S may be collected by surface unit 134 and/or other data collection sources for analysis or other processing. The data collected by sensors S may be used alone or in combination with other data. The data may be collected in one or more databases and/or transmitted on or offsite. All or select portions of the data may be selectively used for analyzing and/or predicting oilfield operations of the current and/or other wellbores. The data may be historical data, real time data, or combinations thereof. The real time data may be used in real time, or stored for later use. The data may also be combined with historical data or other inputs for further analysis. The data may be stored in separate databases, or combined into a single database.

The collected data may be used to perform analysis, such as modeling operations. For example, the seismic data output may be used to perform geological, geophysical, and/or reservoir engineering. The reservoir, wellbore, surface, and/or process data may be used to perform reservoir, wellbore, geological, geophysical, or other simulations. The data outputs from the oilfield operation may be generated directly from the sensors, or after some preprocessing or modeling. These data outputs may act as inputs for further analysis.

The data may be collected and stored at surface unit 134. One or more surface units may be located at oilfield 100, or connected remotely thereto. Surface unit 134 may be a single unit, or a complex network of units used to perform the necessary data management functions throughout the oilfield. Surface unit 134 may be a manual or automatic system. Surface unit 134 may be operated and/or adjusted by a user.

Surface unit 134 may be provided with transceiver 137 to allow communications between surface unit 134 and various portions of oilfield 100 or other locations. Surface unit 134 may also be provided with or functionally connected to one or more controllers for actuating mechanisms at oilfield 100. Surface unit 134 may then send command signals to oilfield 100 in response to data received. Surface unit 134 may receive commands via the transceiver or may execute commands to the controller. A processor may be provided to analyze the data (locally or remotely), make the decisions and/or actuate the controller. In this manner, oilfield 100 may be selectively adjusted based on the data collected. This technique may be used to optimize portions of the oilfield operation, such as controlling drilling, weight on bit, pump rates, or other parameters. These adjustments may be made automatically based on computer protocol, and/or manually by an operator. In some cases, well plans may be adjusted to select optimum operating conditions, or to avoid problems.

Figure 1C:
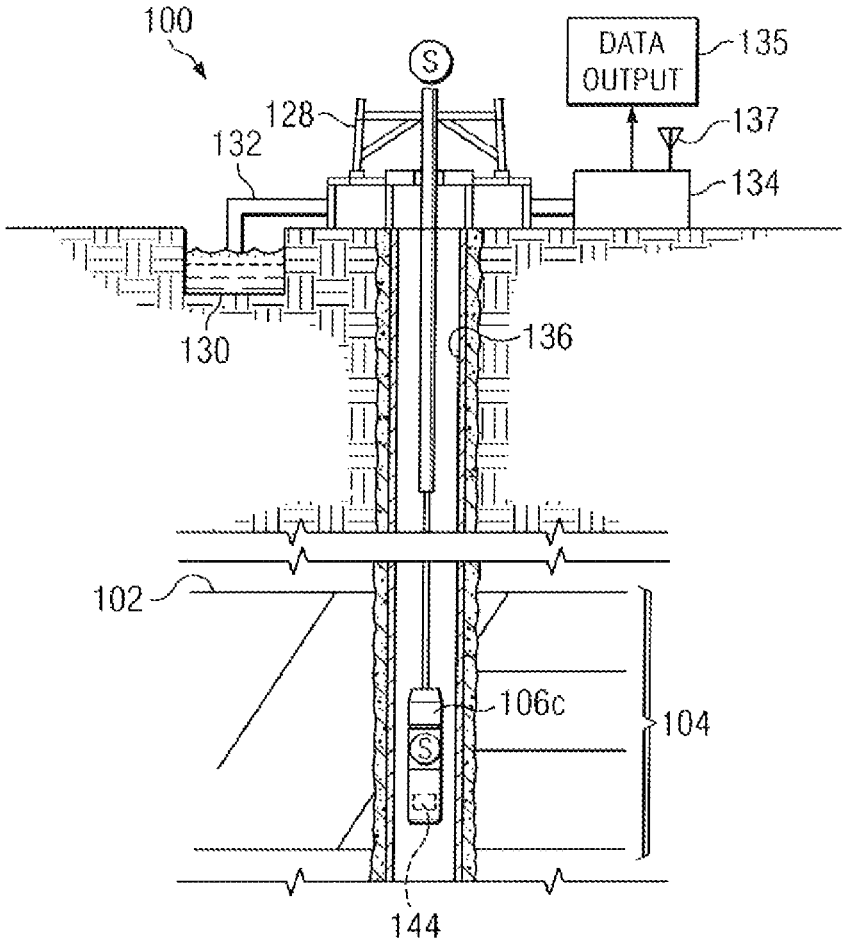

FIG. 1C depicts a wireline operation being performed by wireline tool 106*c* suspended by rig 128 and into wellbore 136 of FIG. 1B. Wireline tool 106*c* is preferably adapted for deployment into a wellbore for generating well logs, performing downhole tests and/or collecting samples. Wireline tool 106*c* may be used to provide another method and apparatus for performing a seismic survey operation. Wireline tool 106*c* of FIG. 1C may, for example, have an explosive, radioactive, electrical, or acoustic energy source 144 that sends and/or receives electrical signals to surrounding subterranean formations 102 and fluids therein.

Wireline tool 106*c* may be operatively connected to, for example, geophones 118 and computer 122*a* of seismic truck 106*a* of FIG. 1A. Wireline tool 106*c* may also provide data to surface unit 134. Surface unit 134 collects data generated during the wireline operation and produces data output 135 that may be stored or transmitted. Wireline tool 106*c* may be positioned at various depths in the wellbore to provide a survey or other information relating to the subterranean formation.

Sensors S, such as gauges, may be positioned about oilfield 100 to collect data relating to various oilfield operations as described previously. As shown, the sensor S is positioned in wireline tool 106*c* to measure downhole parameters that relate to, for example porosity, permeability, fluid composition and/or other parameters of the oilfield operation.

Figure 1D:
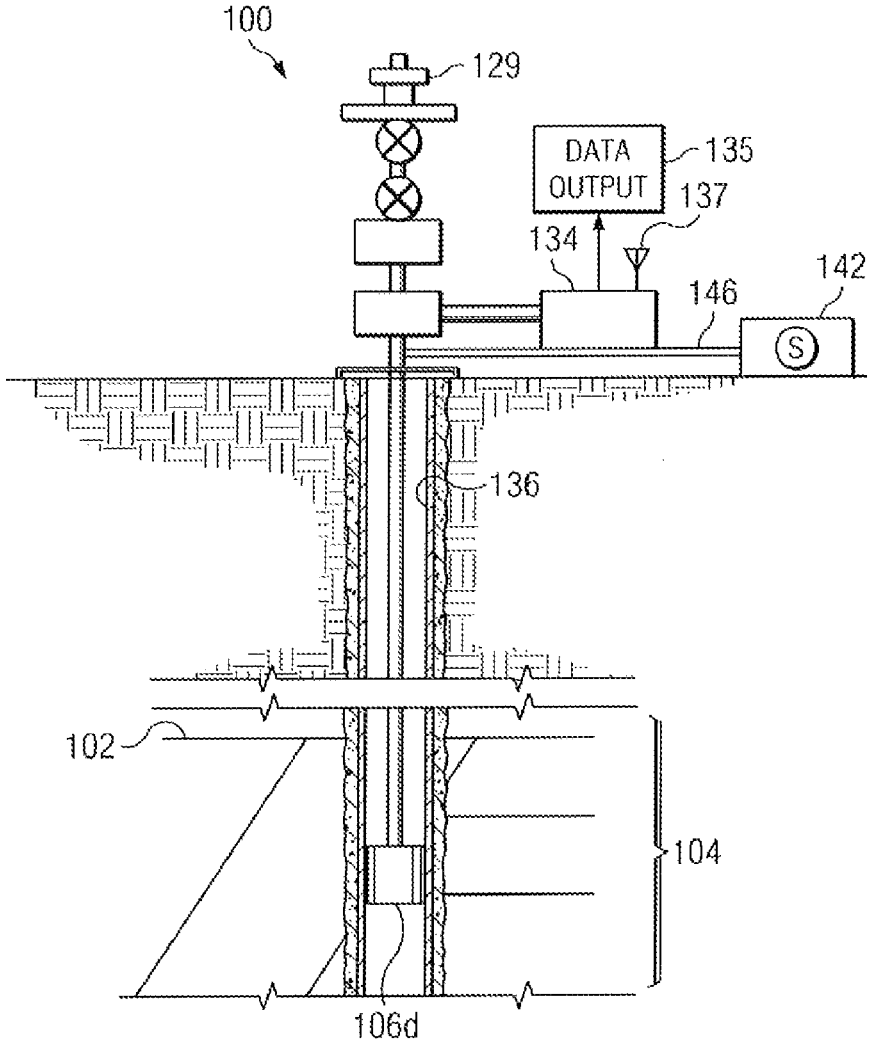

FIG. 1D depicts a production operation being performed by production tool 106*d* deployed from a production unit or Christmas tree 129 and into completed wellbore 136 of FIG. 1C for drawing fluid from the downhole reservoirs into surface facilities 142. Fluid flows from reservoir 104 through perforations in the casing (not shown) and into production tool 106*d* in wellbore 136 and to surface facilities 142 via a gathering network 146.

Sensors S, such as gauges, may be positioned about oilfield 100 to collect data relating to various oilfield operations as described previously. As shown, the sensor S may be positioned in production tool 106*d* or associated equipment, such as Christmas tree 129, gathering network 146, surface facility 142, and/or the production facility, to measure fluid parameters, such as fluid composition, flow rates, pressures, temperatures, and/or other parameters of the production operation.

While only simplified wellsite configurations are shown, it will be appreciated that the oilfield may cover a portion of land, sea, and/or water locations that hosts one or more well sites. Production may also include injection wells (not shown) for added recovery. One or more gathering facilities may be operatively connected to one or more of the well sites for selectively collecting downhole fluids from the wellsite(s).

While FIGS. 1B-1D depict tools used to measure properties of an oilfield, it will be appreciated that the tools may be used in connection with non-oilfield operations, such as mines, aquifers, storage, or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors S may be located at various positions along the wellbore and/or the monitoring tools to collect and/or monitor the desired data. Other sources of data may also be provided from offsite locations.

The oilfield configuration of FIGS. 1A-1D is intended to provide a brief description of an example of an oilfield usable with the present invention. Part, or all, of oilfield 100 may be on land, water, and/or sea. Also, while a single oilfield measured at a single location is depicted, the present invention may be utilized with any combination of one or more oilfields, one or more processing facilities and one or more well sites.

Figure 2A:
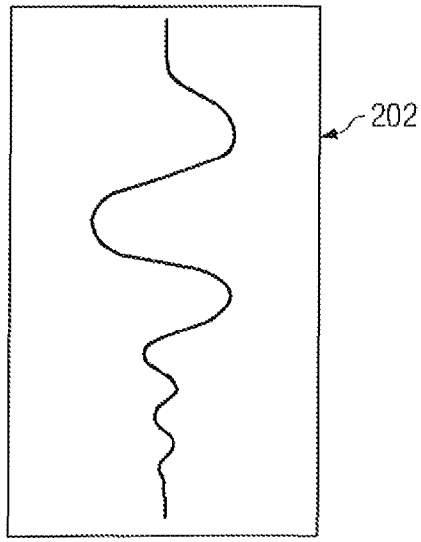
FIGS. 2A-2D are graphical depictions of examples of data collected by the tools of FIGS. 1A-1D.
Figure 2B:
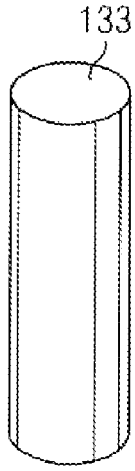
Figure 2C:
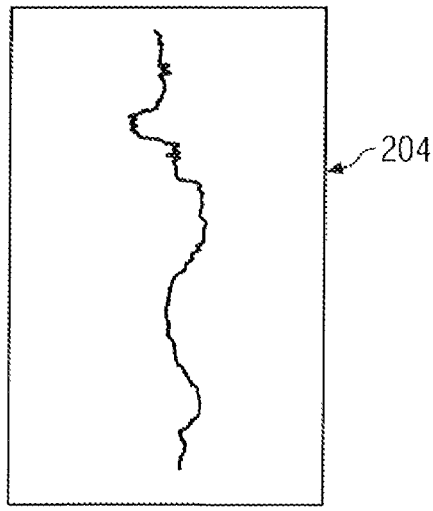
Figure 2D:
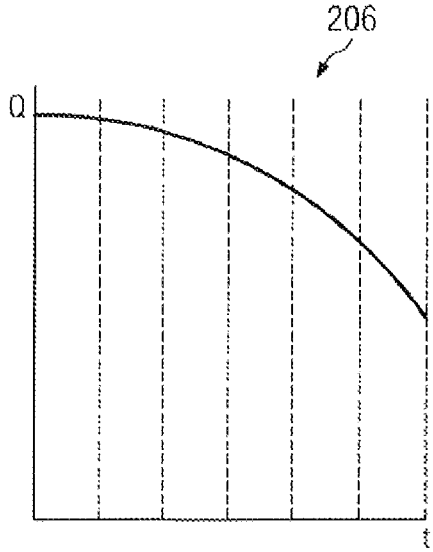

FIGS. 2A-2D are graphical depictions of examples of data collected by the tools of FIGS. 1A-1D, respectively. FIG. 2A depicts seismic trace 202 of the subterranean formation of FIG. 1A taken by seismic truck 106*a*. Seismic trace 202 may be used to provide data, such as a two-way response over a period of time. FIG. 2B depicts core sample 133 taken by drilling tools 106*b*. Core sample 133 may be used to provide data, such as a graph of the density, porosity, permeability, or other physical property of the core sample over the length of the core. Tests for density and viscosity may be performed on the fluids in the core at varying pressures and temperatures. FIG. 2C depicts well log 204 of the subterranean formation of FIG. 1C taken by wireline tool 106*c*. The wireline log typically provides a resistivity or other measurement of the formation at various depths. FIG. 2D depicts a production decline curve or graph 206 of fluid flowing through the subterranean formation of FIG. 1D measured at surface facilities 142. The production decline curve typically provides the production rate Q as a function of time t.

The respective graphs of FIGS. 2A-2C depict examples of static measurements that may describe or provide information about the physical characteristics of the formation and reservoirs contained therein. These measurements may be analyzed to better define the properties of the formation(s) and/or determine the accuracy of the measurements and/or for checking for errors. The plots of each of the respective measurements may be aligned and scaled for comparison and verification of the properties.

FIG. 2D depicts an example of a dynamic measurement of the fluid properties through the wellbore. As the fluid flows through the wellbore, measurements are taken of fluid properties, such as flow rates, pressures, composition, etc. As described below, the static and dynamic measurements may be analyzed and used to generate models of the subterranean formation to determine characteristics thereof. Similar measurements may also be used to measure changes in formation aspects over time.

Figure 3:
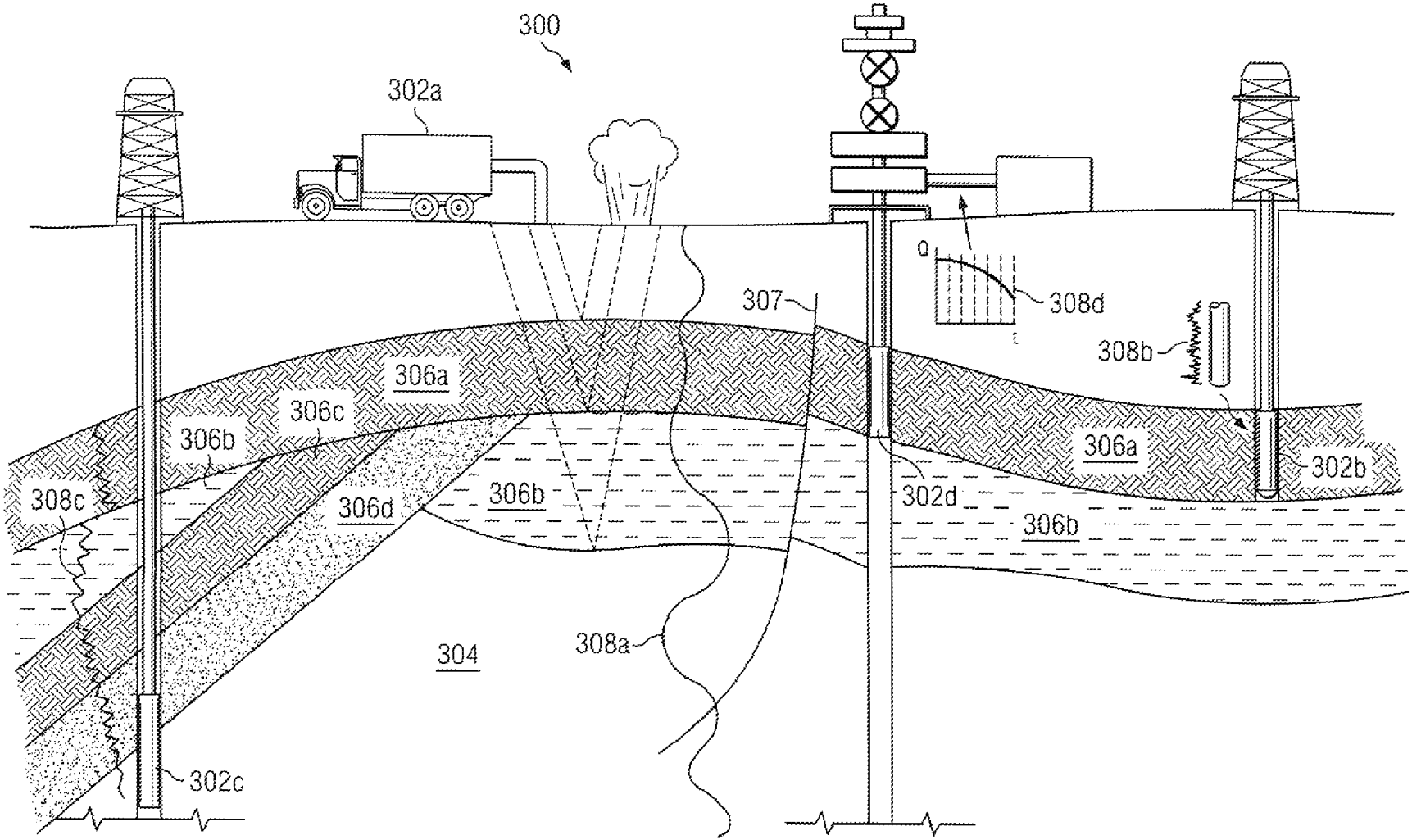
FIG. 3 is a schematic view, partially in cross section of an oilfield having data acquisition tools positioned at various locations along the oilfield for collecting data of the subterranean formation.

FIG. 3 is a schematic view, partially in cross section of oilfield 300 having data acquisition tools 302*a*, 302*b*, 302*c* and 302*d* positioned at various locations along the oilfield for collecting data of the subterranean formation 304. Data acquisition tools 302*a*-302*d* may be the same as data acquisition tools 106*a*-106*d* of FIGS. 1A-1D, respectively, or others not depicted. As shown, data acquisition tools 302*a*-302*d* generate data plots or measurements 308*a*-308*d*, respectively. These data plots are depicted along the oilfield to demonstrate the data generated by the various operations.

Data plots 308*a*-308*c* are examples of static data plots that may be generated by data acquisition tools 302*a*-302*d*, respectively. Static data plot 308*a* is a seismic two-way response time and may be the same as seismic trace 202 of FIG. 2A. Static plot 308*b* is core sample data measured from a core sample of formation 304, similar to core sample 133 of FIG. 2B. Static data plot 308*c* is a logging trace, similar to well log 204 of FIG. 2C. Production decline curve or graph 308*d* is a dynamic data plot of the fluid flow rate over time, similar to graph 206 of FIG. 2D. Other data may also be collected, such as historical data, user inputs, economic information, and/or other measurement data and other parameters of interest.

Subterranean structure 304 has a plurality of geological formations 306*a*-306*d*. As shown, this structure has several formations or layers, including shale layer 306*a*, carbonate layer 306*b*, shale layer 306*c* and sand layer 306*d*. Fault 307 extends through shale layer 306*a* and carbonate layer 306*b*. The static data acquisition tools are preferably adapted to take measurements and detect characteristics of the formations.

While a specific subterranean formation with specific geological structures is depicted, it will be appreciated that the oilfield may contain a variety of geological structures and/or formations, sometimes having extreme complexity. In some locations, typically below the water line, fluid may occupy pore spaces of the formations. Each of the measurement devices may be used to measure properties of the formations and/or its geological features. While each acquisition tool is shown as being in specific locations in the oilfield, it will be appreciated that one or more types of measurement may be taken at one or more locations across one or more oilfields or other locations for comparison and/or analysis.

The data collected from various sources, such as the data acquisition tools of FIG. 3, may then be processed and/or evaluated. Typically, seismic data displayed in static data plot 308*a* from data acquisition tool 302*a* is used by a geophysicist to determine characteristics of the subterranean formations and features. Core data shown in static plot 308*b* and/or log data from well log 308*c* are typically used by a geologist to determine various characteristics of the subterranean formation. Production data from graph 308*d* is typically used by the reservoir engineer to determine fluid flow reservoir characteristics. The data analyzed by the geologist, geophysicist and the reservoir engineer may be analyzed using modeling techniques. Examples of modeling techniques are described in U.S. Pat. No. 5,992,519, WO2004049216, WO1999/064896, U.S. Pat. No. 6,313,837, US2003/0216897, U.S. Pat. No. 7,248,259, US20050149307 and US2006/0197759. Systems for performing such modeling techniques are described, for example, in issued U.S. Pat. No. 7,248,259, the entire contents of which is hereby incorporated by reference.

Figure 4:
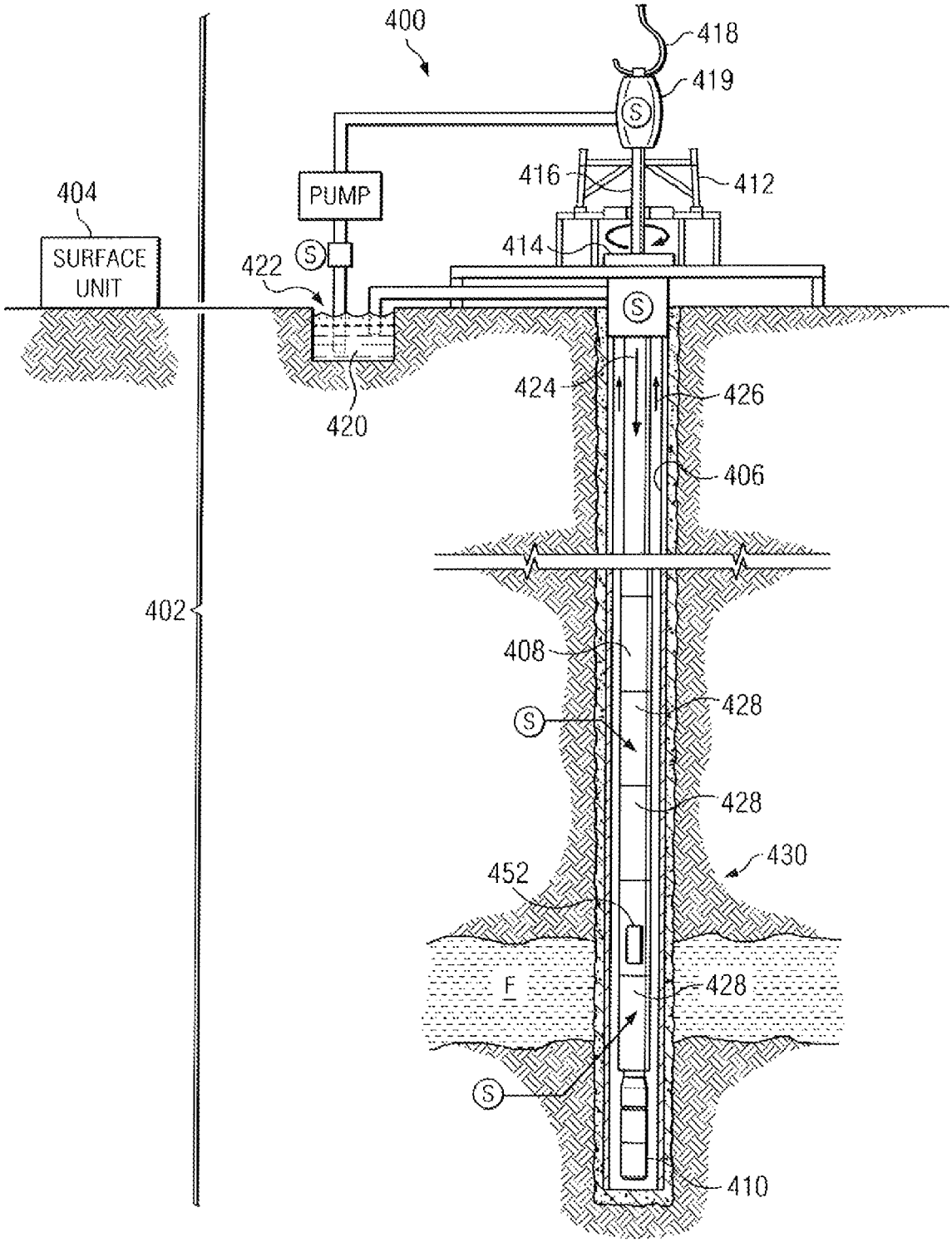
FIG. 4 is a schematic view of a wellsite, depicting a drilling operation of an oilfield in detail.

FIG. 4 is a schematic view of wellsite 400, depicting a drilling operation, such as the drilling operation of FIG. 1B, of an oilfield in detail. Wellsite 400 includes drilling system 402 and surface unit 404. In the illustrated embodiment, borehole 406 is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling), and is not limited to land-based rigs.

Drilling system 402 includes drill string 408 suspended within borehole 406 with drill bit 410 at its lower end. Drilling system 402 also includes the land-based platform and derrick assembly 412 positioned over borehole 406 penetrating subsurface formation F. Assembly 412 includes rotary table 414, kelly 416, hook 418, and a rotary swivel. The drill string 408 is rotated by rotary table 414, energized by means not shown, which engages kelly 416 at the upper end of the drill string. Drill string 408 is suspended from hook 418, attached to a traveling block (also not shown), through kelly 416 and a rotary swivel that permits rotation of the drill string relative to the hook.

Drilling system 402 further includes drilling fluid or mud 420 stored in pit 422 formed at the well site. Pump 424 delivers drilling fluid 420 to the interior of drill string 408 via a port in a rotary swivel, inducing the drilling fluid to flow downwardly through drill string 408 as indicated by directional arrow 424. The drilling fluid exits drill string 408 via ports in drill bit 410, and then circulates upwardly through the region between the outside of drill string 408 and the wall of borehole 406, called annulus 426. In this manner, drilling fluid lubricates drill bit 410 and carries formation cuttings up to the surface as it is returned to pit 422 for recirculation.

Drill string 408 further includes bottom hole assembly (BHA) 430, generally referenced, near drill bit 410 (in other words, within several drill collar lengths from the drill bit). Bottom hole assembly 430 includes capabilities for measuring, processing, and storing information, as well as communicating with surface unit 404. Bottom hole assembly 430 further includes drill collars 428 for performing various other measurement functions.

Sensors S are located about wellsite 400 to collect data, preferably in real time, concerning the operation of wellsite 400, as well as conditions at wellsite 400. Sensors S of FIG. 3 may be the same as sensors S of FIGS. 1A-D. Sensors S of FIG. 3 may also have features or capabilities, of monitors, such as cameras (not shown), to provide pictures of the operation. Sensors S, which may include surface sensors or gauges, may be deployed about the surface systems to provide information about surface unit 404, such as standpipe pressure, hookload, depth, surface torque, and rotary rpm, among others. In addition, sensors S, which include downhole sensors or gauges, are disposed about the drilling tool and/or wellbore to provide information about downhole conditions, such as wellbore pressure, weight on bit, torque on bit, direction, inclination, collar rpm, tool temperature, annular temperature and toolface, among others. The information collected by the sensors and cameras is conveyed to the various parts of the drilling system and/or the surface control unit.

Drilling system 402 is operatively connected to surface unit 404 for communication therewith. Bottom hole assembly 430 is provided with communication subassembly 452 that communicates with surface unit 404. Communication subassembly 452 is adapted to send signals to and receive signals from the surface using mud pulse telemetry. Communication subassembly 452 may include, for example, a transmitter that generates a signal, such as an acoustic or electromagnetic signal, which is representative of the measured drilling parameters. Communication between the downhole and surface systems is depicted as being mud pulse telemetry, such as the one described in U.S. Pat. No. 5,517,464, assigned to the assignee of the present invention. It will be appreciated by one of skill in the art that a variety of telemetry systems may be employed, such as wired drill pipe, electromagnetic or other known telemetry systems.

Typically, the wellbore is drilled according to a drilling plan that is established prior to drilling. The drilling plan typically sets forth equipment, pressures, trajectories and/or other parameters that define the drilling process for the wellsite. The drilling operation may then be performed according to the drilling plan. However, as information is gathered, the drilling operation may need to deviate from the drilling plan. Additionally, as drilling or other operations are performed, the subsurface conditions may change. The earth model may also need adjustment as new information is collected.

Figure 5:
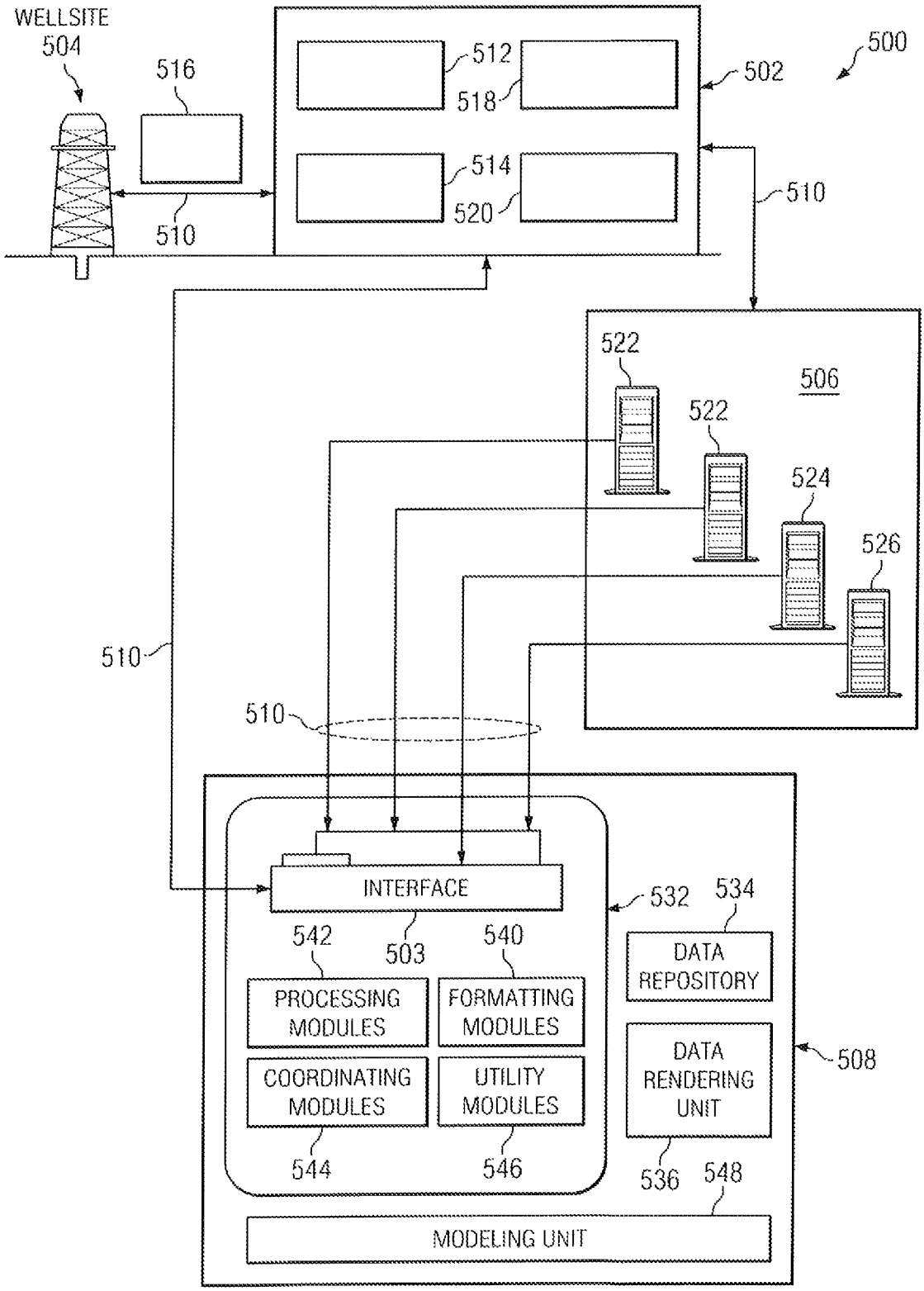
FIG. 5 is a schematic view of a system (SCADA) for acquiring, processing and storing data from a wellsite to a remote (office) location for interpretation and utilization.

FIG. 5 is a schematic view of remote data handling system 500 for data transfer, processing, formatting and repository in oilfield operations. Typical data handled in this process include Production/Injection data as well as pressure data measured by subsurface equipment (Intelligent completion valves) or at wellhead. Other data include acquisition data including logs, drilling events, trajectory, and/or other oilfield data, such as seismic data, The system also allow for remote operation of wellsite equipment from an offsite location As shown, system 500 includes surface unit 502 operatively connected to wellsite 504, servers 506 operatively linked to surface unit 502, and modeling tool 508 operatively linked to servers 506. As shown, communication links 510 are provided between wellsite 504, surface unit 502, servers 506, and modeling tool 508. A variety of links may be provided to facilitate the flow of data through the system. The communication links may provide for continuous, intermittent, one-way, two-way, and/or selective communication throughout system 500. The communication links may be of any type, such as wired, wireless, etc.

Wellsite 504 and surface unit 502 may be the same as the wellsite and surface unit of FIG. 3. Surface unit 502 is preferably provided with an acquisition component 512, controller 514, display unit 516, processor 518 and transceiver 520. Acquisition component 512 collects and/or stores data of the oilfield. This data may be data measured by the sensors S of the wellsite as described with respect to FIG. 3. This data may also be data received from other sources.

Controller 514 is enabled to enact commands at oilfield 500. Controller 514 may be provided with actuation means that can perform drilling operations, such as steering, advancing, or otherwise taking action at the wellsite. Drilling operations may also include, for example, acquiring and analyzing oilfield data, modeling oilfield data, managing existing oilfields, identifying production parameters, maintenance activities, or any other actions. Commands may be generated based on logic of processor 518, or by commands received from other sources. Processor 518 is preferably provided with features for manipulating and analyzing the data. The processor may be provided with additional functionality to perform oilfield operations.

Display unit 516 may be provided at wellsite 504 and/or remote locations for viewing oilfield data. The oilfield data displayed may be raw data, processed data, and/or data outputs generated from various data. The display is preferably adapted to provide flexible views of the data, so that the screens depicted may be customized as desired.

Transceiver 520 provides a means for providing data access to and/or from other sources. Transceiver 520 also provides a means for communicating with other components, such as servers 506, wellsite 504, surface unit 502, and/or modeling tool 508.

Server 506 may be used to transfer data from one or more well sites to modeling tool 508. As shown, server 506 includes onsite servers 522, remote server 524, and third party server 526. Onsite servers 522 may be positioned at wellsite 504 and/or other locations for distributing data from surface unit 502. Remote server 524 is positioned at a location away from oilfield 504 and provides data from remote sources. Third party server 526 may be onsite or remote, but is operated by a third party, such as a client.

Servers 506 are capable of transferring drilling data, such as logs, drilling events, trajectory, and/or other oilfield data, such as seismic data, production/injection data, pressure data, historical data, economics data, or other data that may be of use during analysis. The type of server is not intended to limit the invention. Preferably system 500 is adapted to function with any type of server that may be employed.

Servers 506 communicate with modeling tool 508 as indicated by communication links 510. As indicated by the multiple arrows, servers 506 may have separate communication links with modeling tool 508. One or more of the servers of servers 506 may be combined or linked to provide a combined communication link.

Servers 506 collect a wide variety of data. The data may be collected from a variety of channels that provide a certain type of data, such as well logs. The data from servers 506 is passed to modeling tool 508 for processing. Servers 506 may be used to store and/or transfer data.

Modeling tool 508 is operatively linked to surface unit 502 for receiving data therefrom. In some cases, modeling tool 508 and/or server(s) 506 may be positioned at wellsite 504. Modeling tool 508 and/or server(s) 506 may also be positioned at various locations. Modeling tool 508 may be operatively linked to surface unit 502 via server(s) 506. Modeling tool 508 may also be included in or located near surface unit 502.

Modeling tool 508 includes interface 503, processing unit 532, modeling unit 548, data repository 534 and data rendering unit 536. Interface 503 communicates with other components, such as servers 506. Interface 503 may also permit communication with other oilfield or non-oilfield sources. Interface 503 receives the data and maps the data for processing. Data from servers 506 typically streams along predefined channels that may be selected by interface 503.

As depicted in FIG. 5, interface 503 selects the data channel of server(s) 506 and receives the data. Interface 503 also maps the data channels to data from wellsite 504. The data may then be passed to the processing unit of modeling tool 508. Preferably, the data is immediately incorporated into modeling tool 508 for real-time sessions or modeling. Interface 503 creates data requests (for example surveys, logs, and risks), displays the user interface, and handles connection state events. It also instantiates the data into a data object for processing.

Processing unit 532 includes formatting modules 540, processing modules 542, coordinating modules 544, and utility modules 546. These modules are designed to manipulate the oilfield data for real-time analysis.

Formatting modules 540 are used to conform data to a desired format for processing. Incoming data may need to be formatted, translated, converted or otherwise manipulated for use. Formatting modules 540 are configured to enable the data from a variety of sources to be formatted and used so that it processes and displays in real time.

Formatting modules 540 include components for formatting the data, such as a unit converter and the mapping components. The unit converter converts individual data points received from interface 503 into the format expected for processing. The format may be defined for specific units, provide a conversion factor for converting to the desired units, or allow the units and/or conversion factor to be defined. To facilitate processing, the conversions may be suppressed for desired units.

The mapping component maps data according to a given type or classification, such as a certain unit, log mnemonics, precision, max/min of color table settings, etc. The type for a given set of data may be assigned, particularly when the type is unknown. The assigned type and corresponding map for the data may be stored in a file (e.g. XML) and recalled for future unknown data types.

Coordinating modules 544 orchestrate the data flow throughout modeling tool 508. The data is manipulated so that it flows according to a choreographed plan. The data may be queued and synchronized so that it processes according to a timer and/or a given queue size. The coordinating modules include the queuing components, the synchronization components, the management component, modeling tool 508 mediator component, the settings component and the real-time handling component.

The queuing module groups the data in a queue for processing through the system. The system of queues provides a certain amount of data at a given time so that it may be processed in real time.

The synchronization component links certain data together so that collections of different kinds of data may be stored and visualized in modeling tool 508 concurrently. In this manner, certain disparate or similar pieces of data may be choreographed so that they link with other data as it flows through the system. The synchronization component provides the ability to selectively synchronize certain data for processing. For example, log data may be synchronized with trajectory data. Where log samples have a depth that extends beyond the wellbore, the samples may be displayed on the canvas using a tangential projection so that, when the actual trajectory data is available, the log samples will be repositioned along the wellbore. Alternatively, incoming log samples that are not on the trajectory may be cached so that, when the trajectory data is available, the data samples may be displayed. In cases where the log sample cache fills up before the trajectory data is received, the samples may be committed and displayed.

The settings component defines the settings for the interface. The settings component may be set to a desired format and adjusted as necessary. The format may be saved, for example, in an extensible markup language (XML) file for future use.

The real-time handling component instantiates and displays the interface and handles its events. The real-time handling component also creates the appropriate requests for channel or channel types, handles the saving and restoring of the interface state when a set of data or its outputs is saved or loaded.

The management component implements the required interfaces to allow the module to be initialized by and integrated for processing. The mediator component receives the data from the interface. The mediator caches the data and combines the data with other data as necessary. For example, incoming data relating to trajectories, risks, and logs may be added to wellbores stored in modeling tool 508. The mediator may also merge data, such as survey and log data.

Utility modules 546 provide support functions to the processing system. Utility modules 546 include the logging component and the user interface (UI) manager component. The logging component provides a common call for all logging data. This module allows the logging destination to be set by the application. The logging module may also be provided with other features, such as a debugger, a messenger, and a warning system, among others. The debugger sends a debug message to those using the system. The messenger sends information to subsystems, users, and others. The information may or may not interrupt the operation and may be distributed to various locations and/or users throughout the system. The warning system may be used to send error messages and warnings to various locations and/or users throughout the system. In some cases, the warning messages may interrupt the process and display alerts.

The UI manager component creates user interface elements for displays. The UI manager component defines user input screens, such as menu items, context menus, toolbars, and settings windows. The user manager may also be used to handle events relating to these user input screens.

Processing module 542 is used to analyze the data and generate outputs. Processing module 542 includes the trajectory management component.

The trajectory management component handles the case when the incoming trajectory information indicates a special situation or requires special handling (such as the data pertains to depths that are not strictly increasing or the data indicates that a sidetrack borehole path is being created). For example, when a sample is received with a measured depth shallower than the hole depth, the trajectory module determines how to process the data. The trajectory module may ignore all incoming survey points until the MD exceeds the previous MD on the wellbore path, merge all incoming survey points below a specified depth with the existing samples on the trajectory, ignore points above a given depth, delete the existing trajectory data and replace it with a new survey that starts with the incoming survey station, create a new well and set its trajectory to the incoming data, and add incoming data to this new well, and prompt the user for each invalid point. All of these options may be exercised in combinations and can be automated or set manually.

Data repository 534 stores the data for modeling unit 548. The data is preferably stored in a format available for use in real-time. The data is passed to data repository 534 from the processing component. It can be persisted in the file system (e.g., as an XML File) or in a database. The system determines which storage is the most appropriate to use for a given piece of data and stores the data there in a manner that enables automatic flow of the data through the rest of the system in a seamless and integrated fashion. It also facilitates manual and automated workflows (such as modeling, geological & geophysical and production/injection ones) based upon the persisted data.

Data rendering unit 536 provides one or more displays for visualizing the data. Data rendering unit 536 may contain a 3D canvas, a well section canvas or other canvases as desired. Data rendering unit 536 may selectively display any combination of one or more canvases. The canvases may or may not be synchronized with each other during display. The display unit is preferably provided with mechanisms for actuating various canvases or other functions in the system.

While specific components are depicted and/or described for use in the modules of modeling tool 508, it will be appreciated that a variety of components with various functions may be used to provide the formatting, processing, utility, and coordination functions necessary to provide real-time processing in modeling tool 508. The components and/or modules may have combined functionalities.

Modeling unit 548 performs the key modeling functions for generating complex oilfield outputs. Modeling unit 548 may be a conventional modeling tool capable of performing modeling functions, such as generating, analyzing, and manipulating earth models. The earth models typically contain exploration and production data, such as that shown in FIG. 1.

The data available in data repository 534 can also be extracted to create a customized static database dump for the purpose of statistical analysis using other established and novel workflows and programs with the objective of optimizing the oilfield performance.

Figure 6:
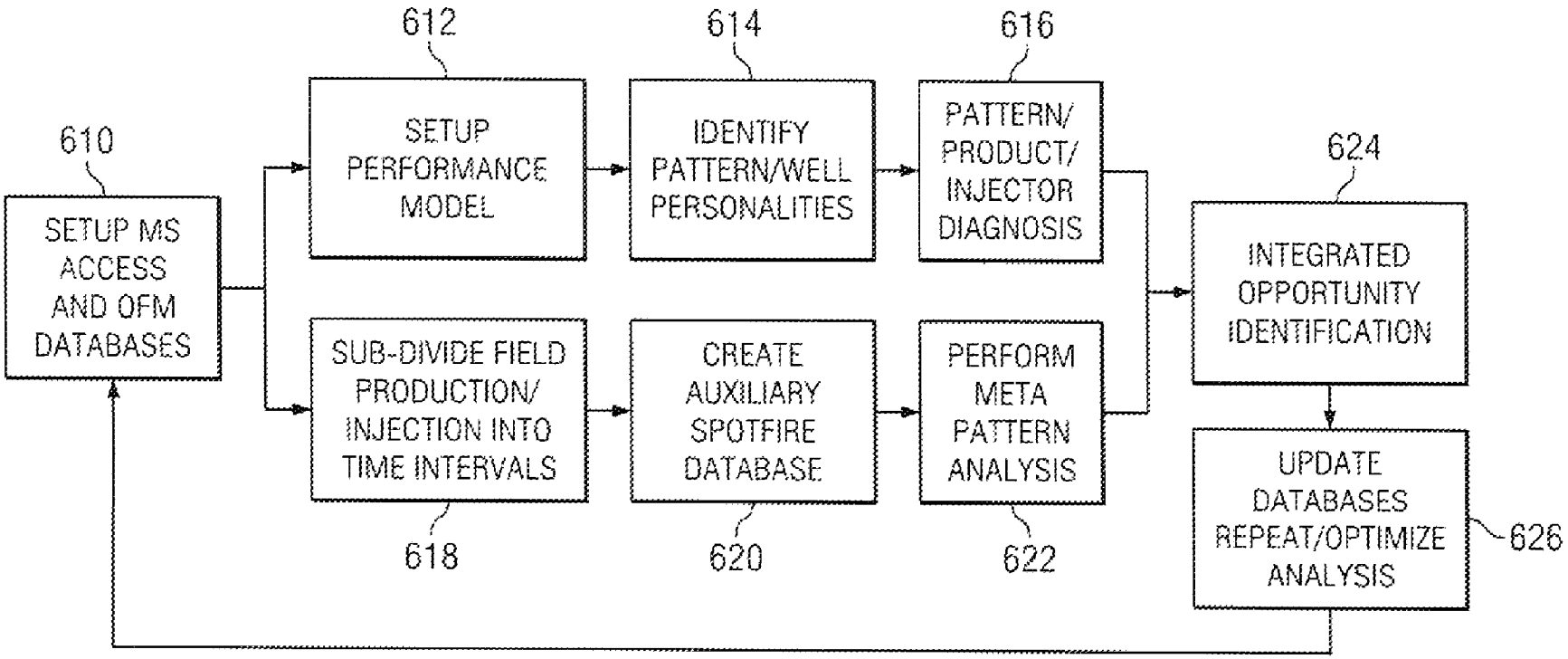
FIG. 6 is a high level flow chart for performing statistical analysis of historical oilfield data according to an illustrative embodiment.

Referring now to FIG. 6, a high-level flow chart for performing statistical analysis of historical oilfield data is shown according to an illustrative embodiment. Process 600 is an analysis process to assist optimizing mature producing oilfields. It is intended primarily for waterflood, CO2 Flood and Steamflood optimization. Nevertheless it can also be used for oilfields under primary depletion. Process 600 can be a software process, executing on a system component, such as modeling unit 548 of FIG. 5.

Process 600 begins by setting up initial databases that contain historical production/injection data on a well basis. This information is collected from the oilfield to be later processed (step 610). From there, process 600 executes two separate statistical treatments of the historical data to arrive at a final characterization of the field and well performance for the purpose of optimizing or increasing hydrocarbon production from the oilfield.

Process steps 612-616 are a high-level view of the process called Performance Model (PM), which is the first statistical treatment of the historical data. An initial Performance Model is set up (step 612). From the initial Performance Model, personalities for wells and/or patterns are determined (step 614). Finally, diagnostics of the wells and/or patterns are obtained (step 616).

Process steps 618-622 are a high-level view of the process called Meta Patterns (MP), which is the second statistical treatment of the historical data. Field historical production/injection data is subdivided into time intervals (step 618) and an auxiliary Spotfire® database is set up (Step 620). Finally, a Meta Pattern analysis is performed on each subdivided time interval (step 622).

Currently, Performance Model (PM) and Meta Patterns (MP) are independent processes with the same final goal of production optimization. Nevertheless, the individual results can be combined to get a more integrated opportunity (step 624). Finally, the initial databases would be updated with the results of both processes (step 626). The process can then return to step 610 for repeated iterations of the process.

From the statistical results generated by process 600, under performing wells and/or patterns are identified and prioritized based on the production/injection performance of those wells. Oilfield operations, including potential infill development, recompletion, and stimulation, can be guided based on the results generated.

Referring now generally to FIGS. 7-13, a detailed discussion of Performance Model analysis technique is described. The Performance Model analysis technique enables effective analysis of large amounts of production and injection data. The main objective of Performance Model analysis is to increase operation efficiency in monitoring production and injection performance in the fields. The performance model analysis leads to identifying and ranking underperforming wells and/or patterns for future workover opportunities, prevent hyper-management of better-performing wells and/or patterns and also leads to identifying areas for enhancing injection efficiency. The performance model analysis technique's method of heterogeneity indexing is a production/injection ranking system that can be characterized by equation 1:

$$MHI_{Fluid} = \sum_{t=0}^{t_{max}} \left[ \frac{Fluid_{well} - Fluid_{avg\ well}}{Fluid_{max\ well} - Fluid_{min\ well}} \right] \quad \text{Equation 1}$$

where:

$MHI_{Fluid}$ is a modified heterogeneity index for any type of fluid production ratio.

$Fluid_{well}$ is fluid production for each well being considered in a reservoir or field at time t;

$Fluid_{avg\ well}$ is the average fluid production for all the wells being considered in a reservoir or field at time t;

$Fluid_{max\ well}$ is the fluid production for the maximum producing well being considered in a reservoir or field at time t; and $Fluid_{min\ well}$ is the fluid production for the minimum producing well being considered in a reservoir or field at time t.

The fluid produced ($Fluid_{well}$) from the well may be oil, water, gas, barrels of oil equivalent, total liquid, gas/oil ratio or water cut and may consist of either "rate" or "cumulative" numbers. Additionally, $Fluid_{well}$ can also be fluids injected into the well (water or gas). $Fluid_{well}$ values characteristically exist between 0 and infinity. Based on equation 1, modified heterogeneity index values are always bound between −1 and 1 at every instance of time t. The following two examples are illustrative of these upper and lower limit boundaries.

EXAMPLE 1

At any instant of time t, $Fluid_{well}$ value is equal to or greater than $Fluid_{min\ well}$. If the $Fluid_{well}$ is at the lowest possible value 0, then $Fluid_{min\ well}$ is also 0. The modified heterogeneity index equation (Equation 1) becomes $$MHI_{Fluid} = \left. \frac{-Fluid_{avg\ well}}{Fluid_{max\ well}} \right|_t \quad \text{Equation 2}$$

where:

$$Fluid_{well} \geqq Fluid_{min\ well} \rightarrow 0$$

Since $Fluid_{max\ well}$ is always greater than $Fluid_{avg\ well}$, the modified heterogeneity index is always greater than −1.

EXAMPLE 2

At any instant of time t, $Fluid_{well}$ value is equal to or less than $Fluid_{max\ well}$. If the $Fluid_{well}$ value approaches infinity, then for approximation purposes it can be replaced with $Fluid_{max\ well}$. The numerator of the modified heterogeneity index equation is always less than the denominator because $Fluid_{avg\ well}$ is always greater than $Fluid_{min\ well}$. Therefore, the modified heterogeneity index value is always less than 1 as shown in Equation 3.

$$(Fluid_{max\ well} - Fluid_{avg\ well}) \leqq (Fluid_{max\ well} - Fluid_{min\ well}) \quad \text{Equation 3}$$

where:

$$Fluid_{well} \leqq Fluid_{max\ well} \rightarrow \text{infinity}$$

Equation 1 therefore gives a dimensionless value for quantitative comparison of production/injection performance for various wells and/or patterns within a field. For a given period of field study time, a positive modified heterogeneity index value at the end of the time period means that the well is outperforming the average well while a negative modified heterogeneity index implies an underperforming well. The modified heterogeneity index can be used for comparing either only producer wells or only injector wells and also for comparing patterns. A pattern is a collection of wells and there could be many patterns within a field. Patterns are frequently present in a field where water or gas is being injected into the reservoir. When comparing patterns, the modified heterogeneity index is calculated using previously assigned geometric factors for the wells included in the pattern. As before, a positive modified heterogeneity index indicates a pattern that is outperforming the average pattern while a negative modified heterogeneity index implies an underperforming pattern.

Cross-hair scatter plots similar to FIG. 7*a-b* or FIG. 8*a-b* are used to graphically present the results of the modified heterogeneity index calculations. Nevertheless, using only these types of plots to analyze production/injection behavior over a period of time is an inefficient process especially when large amount of production and injection data is involved. Therefore the addition of binary codes and personality analysis are necessary Performance Model uses binary codes and personality analysis which are related to cross-hair plots. An illustrative example of this relation for a simple set of patterns and only 3 variables: oil production ($q_o$) rate, water production ($q_w$) rate, and water injection ($i_w$) rate) is presented in FIG. 7*a-b* and FIG. 8*a-b*. Specific pattern personalities are established for each individual pattern and implementation plans are suggested based on the established personality.

Figure 7A:
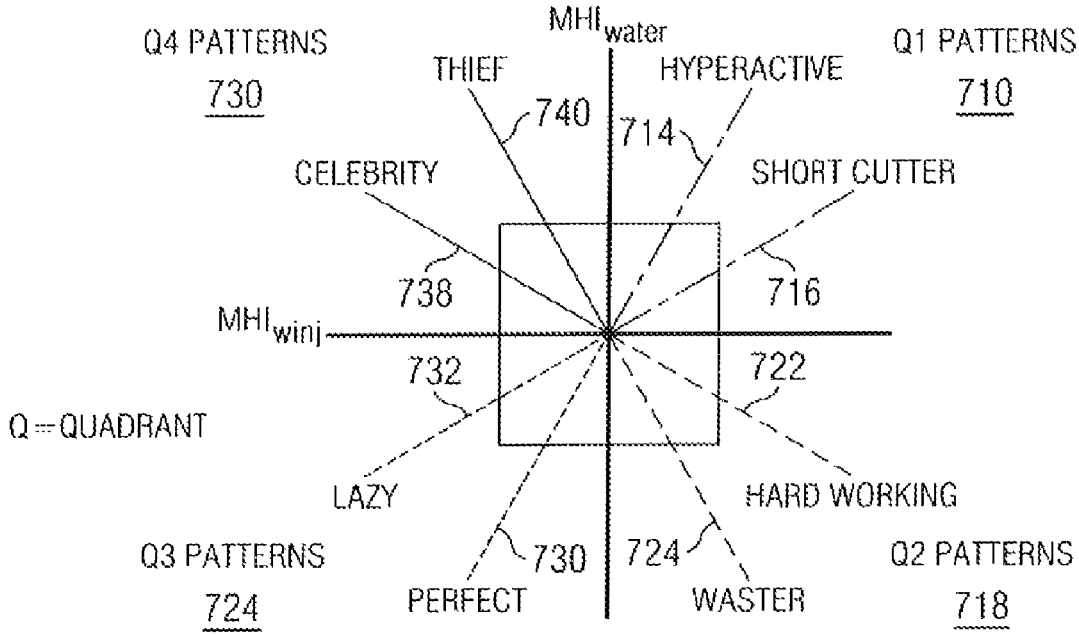
FIG. 7*a-b* are typical modified heterogeneity index results for water production ($q_w$) rates and water injection ($i_w$) rates at a pattern level according to an illustrative embodiment.
Figure 7B:
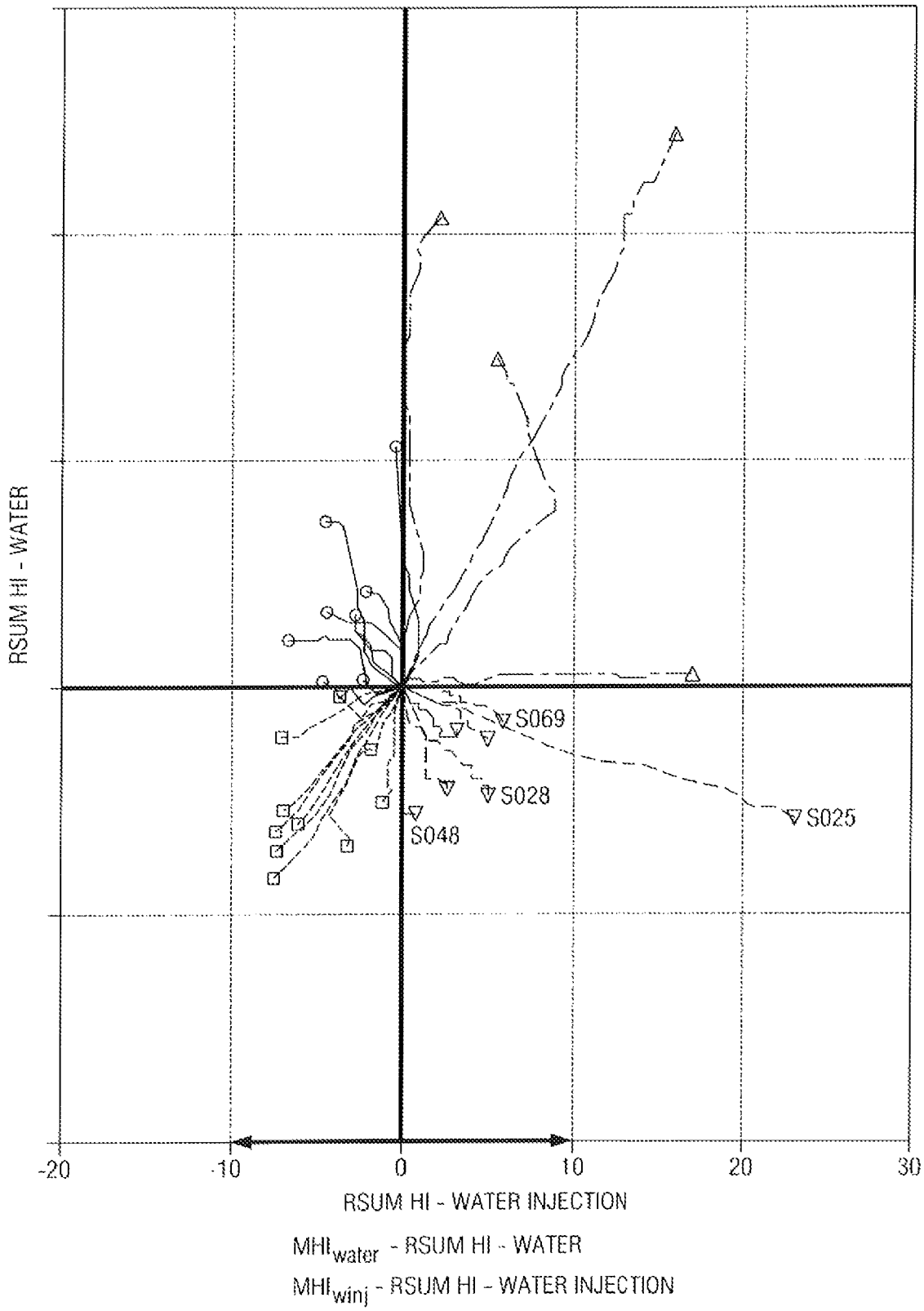

Referring now to FIG. 7*a-b*, typical modified heterogeneity index results for water production ($q_w$) rates and water injection ($i_w$) rates at a pattern level are shown according to an illustrative embodiment. FIG. 7*a-b* shows the modified heterogeneity index for water production versus the modified heterogeneity index for water injection. FIG. 7*a* is a simplified representative graph of FIG. 7*b* which is derived from actual field data.

The patterns inside Quadrant 1 patterns 710 are indicative of patterns within the field that have both a higher water injection ($i_w$) rate than the average pattern, and also a higher water production ($q_w$) rate than the average pattern. Individual patterns 714 and 716 are indicated as Quadrant 1 patterns 710.

The patterns inside Quadrant 2 patterns 718 are indicative of patterns within the field that have a higher water injection ($i_w$) rate than the average pattern, but a lower water production ($q_w$) rate than the average pattern. Individual patterns 722 and 724 are indicated as Quadrant 2 patterns 718.

The patterns inside Quadrant 3 patterns 724 are indicative of patterns within the field that have both a lower water injection ($i_w$) rate than the average pattern, and also a lower water production ($q_w$) rate than the average pattern. Individual patterns 730 and 732 are indicated as Quadrant 3 patterns 724.

The patterns inside Quadrant 4 patterns 730 are indicative of patterns within the field that have a lower water injection ($i_w$) rate than the average pattern, but a higher water production ($q_w$) rate than the average pattern. Individual patterns 738 and 740 are indicated as Quadrant 4 patterns 730.

Figure 8A:
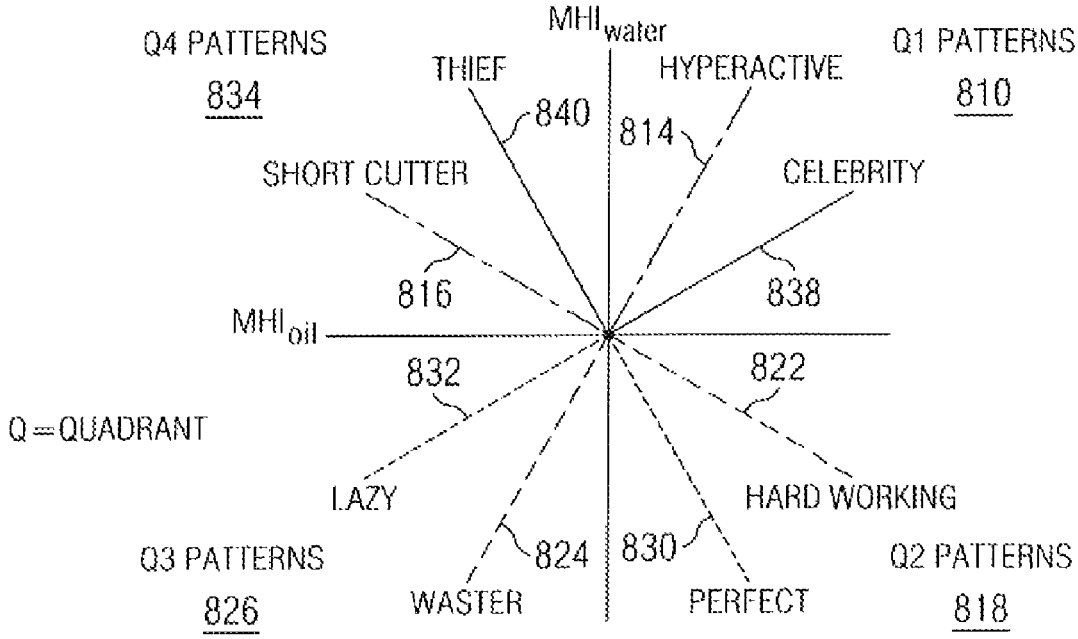
FIG. 8*a-b* are typical modified heterogeneity index results for water production ($q_w$) rates and oil production ($q_o$) rates at pattern level according to an illustrative embodiment.
Figure 8B:
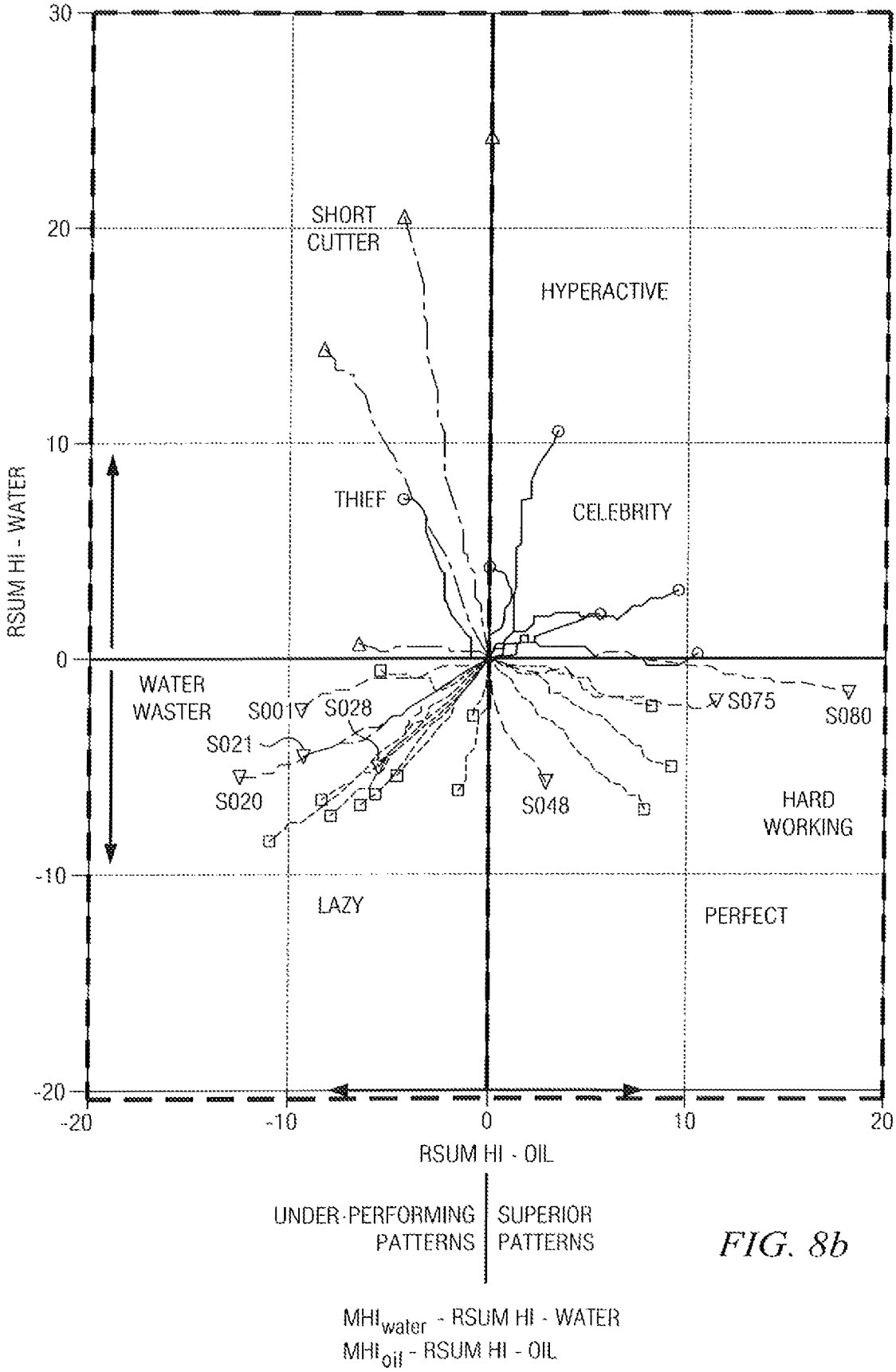

Referring now to FIG. 8*a-b*, typical modified heterogeneity index results for water production ($q_w$) rates and oil production ($q_o$) rates at pattern level are shown according to an illustrative embodiment. FIG. 8*a-b* shows the modified heterogeneity index for water production versus the modified heterogeneity index for oil production. FIG. 8*a-b* shows the same patterns indicated in FIG. 7*a-b*. For example, individual pattern 814 is individual pattern 714 of FIG. 7*a-b*. FIG. 8*a* is a simplified representative graph of FIG. 8*b* which is derived from actual field data.

Patterns for Quadrant 1 patterns 810 are indicative of patterns within the field that have both a higher oil production ($q_o$) rate than the average pattern, and also a higher water production ($q_w$) rate than the average pattern. Individual patterns 814 and 838 are indicated as Quadrant 1 patterns 810. Individual pattern 814 is individual pattern 714 of FIG. 7*a-b*. Individual pattern 838 is individual pattern 738 of FIG. 7*a-b*.

Patterns for Quadrant 2 patterns 818 are indicative of patterns within the field that have a higher oil production ($q_o$) rate than the average pattern, but a lower water production ($q_w$) rate than the average pattern. Individual patterns 822 and 830 are indicated as Quadrant 2 patterns 818. Individual pattern 822 is individual pattern 722 of FIG. 7*a-b*. Individual pattern 830 is individual pattern 730 of FIG. 7*a-b*.

Patterns for Quadrant 3 patterns 826 are indicative of patterns within the field that have both a lower oil production ($q_o$) rate than the average pattern, and also a lower water production ($q_w$) rate than the average pattern. Individual patterns 824 and 832 are indicated as Quadrant 3 patterns 826. Individual pattern 824 is individual pattern 724 of FIG. 7*a-b*. Individual pattern 832 is individual pattern 732 of FIG. 7*a-b*.

Patterns for Quadrant 4 patterns 834 are indicative of patterns within the field that have a lower oil production ($q_o$) rate than the average pattern, but a higher water production ($q_w$) rate than the average pattern. Individual patterns 816 and 840 are indicated as Quadrant 4 patterns 834. Individual pattern 816 is individual pattern 716 of FIG. 7*a-b*. Individual pattern 840 is individual pattern 740 of FIG. 7*a-b*.

Referring now to FIG. 9, a simplified pattern personality analysis is shown according to an illustrative embodiment. FIG. 9 shows the relationship between 3 variables: oil production ($q_o$) rate, water production ($q_w$) rate, and water injection ($i_w$) rate) and it is summarized into eight types of pattern personalities. A variable performing above average is assigned "HI" and coded as 1, and a variable performing below average is assigned "LO" and coded as 0.

First pattern personality 910 is called "lazy" pattern. Individual pattern 832 of FIG. 8*a-b* is illustrative of the "lazy" first pattern personality 910. First pattern personality 910 is characterized by water injection ($i_w$) rate, oil production ($q_o$) rate and water production ($q_w$) rate all below the pattern average. The consequence of low injection is low production; therefore, these patterns are categorized as "lazy" patterns. A "lazy" pattern personality indicates an opportunity to further increase water injection ($i_w$) rates in these patterns. The cause of low injection can be investigated to determine if the injectors are impaired from injection due to water supply/facilities issues and/or if the producers in these patterns have developed positive skin.

Second pattern personality 912 is called a "waster" pattern. Individual pattern 824 of FIG. 8*a-b* is illustrative of the "waster" second pattern personality 912. Second pattern personality 912 is characterized by an above average water injection ($i_w$) rate, but a below average oil production ($q_o$) rate and water production ($q_w$) rate relative to the pattern average. Patterns categorized as "waster" patterns strongly indicate that the water injected into the pattern does not affect the oil production. The below average water production of "waster" patterns suggests that the injected water is probably being wasted in the formation. A typical diagnostic of "waster" patterns is to check out perforation conformance and geological features surrounding the producers and injectors in the patterns.

Third pattern personality 914 is called a "thief" pattern. Individual pattern 840 of FIG. 8*a-b* is illustrative of the "thief" third pattern personality 914. Third pattern personality 914 is characterized by a below average water injection ($i_w$) rate, but a below average oil production ($q_o$) rate and above average water production ($q_w$) rate relative to the pattern average. Patterns categorized as "thief" patterns could indicate that water is being stolen from elsewhere in the formation and/or surrounding patterns.

Fourth pattern personality 916 is called a "short cutter" pattern. Individual pattern 816 of FIG. 8*a-b* is illustrative of the "short cutter" fourth pattern personality 916. Fourth pattern personality 916 is characterized by an above average water injection ($i_w$) rate, and also an above average water production ($q_w$) rate. However, patterns categorized as "short cutter" patterns have a below average oil production ($q_o$) rate, which suggests that injected water is "shortcutting" the reservoir from injectors to producers. The injected water is not effectively contributing to sweep the reservoir and improve oil production. A possible diagnostic of "short cutter" patterns is running production logging tools or injecting radioactive tracers between producers and injectors to better understand these phenomena.

Fifth pattern personality 918 is called a "perfect" pattern. Individual pattern 830 of FIG. 8*a-b* is illustrative of the "perfect" fifth pattern personality 918. Fifth pattern personality 918 is characterized by an above average oil production ($q_o$) rate, while the water injection ($i_w$) rate and water production ($q_w$) rate remain below average, relative to the pattern average. Patterns categorized as "perfect" patterns require the least attention of all pattern types, leaving engineering efforts to be focused on more important issues.

Sixth pattern personality 920 is called a "hard working" pattern. Individual pattern 822 of FIG. 8*a-b* is illustrative of the "hard working" sixth pattern personality 920. Sixth pattern personality 920 is characterized by an above average oil production ($q_o$) rate and water injection ($i_w$) rate, but below average water production ($q_w$) rate, relative to the pattern average. Patterns categorized as "hard working" patterns work hard for their compensation (oil production) and are not problematic (low water production). An empirical optimal water injection rate can be estimated from "hard working" patterns in the field.

Seventh pattern personality 922 is called a "celebrity" pattern. Individual pattern 838 of FIG. 8*a-b* is illustrative of the "celebrity" seventh pattern personality 922. Seventh pattern personality 922 is characterized by an above average oil production ($q_o$) rate and water production ($q_w$) rate but a below average water injection ($i_w$) rate, relative to the pattern average. The over production of water in "celebrity" patterns may come from strong injectors outside the pattern. Reducing the injection rates in nearby injectors or performing water control techniques on the producer wells may reduce the water problem Eighth pattern personality 924 is called a "hyperactive" pattern. Individual pattern 814 of FIG. 8*a-b* is illustrative of the "hyperactive" eighth pattern personality 924. Eighth pattern personality 924 is characterized by an above average water injection ($i_o$) rate, above average water production ($q_w$) rate, and above average oil production ($q_o$) rate. It is possible that the injector wells inside "hyperactive" patterns do not need "hyper" water injection activity. Some of the wells in this pattern may be candidates for water control intervention.

The above illustrative example with eight pattern personality types is the simplified version of pattern personality analysis based on only three variables. However, more personalities need to be implemented when using additional variables. In general, depending on the number of variables that are included, a multitude of different personality types can be obtained. The number of potential personality types can be as many as $2^x$, where x is the number of variables that are evaluated for the well.

Referring now to FIG. 10, an expanded pattern personality analysis is shown according to an illustrative embodiment. The expanded pattern personality analysis of FIG. 10 shows the relationship between each of 5 variables on a pattern basis: oil production ($q_o$) rate 1010, water production ($q_w$) rate 1012, gas production ($q_g$) rate 1014, water injection ($i_w$) rate 1016, and gas injection ($i_g$) rate 1018. The expanded pattern personality analysis summarized into $2^5$, or 32 types of pattern personalities.

Referring now to FIG. 11, an expanded personality analysis for producing wells is shown according to an illustrative embodiment. FIG. 11 is a personality analysis using only producer wells and 3 production variables (oil production ($q_o$) rate 1110, water production ($q_w$) rate 1112, and gas production ($q_g$) rate 1114). From the combination of the previous 3 variables, eight producer personalities are generated. These producer personalities can be subdivided into two major groups: under-performing producers 1116 and superior producers 1126.

Under-performing producers 1116 are characterized by oil production ($q_o$) rate 1110 below the average producer. Under-performing producers 1116 can be further sub-divided into 4 subgroups.

"Lazy" producers 1118 are characterized by having a below average oil production ($q_o$) rate 1110, water production ($q_w$) rate 1112, and also gas production ($q_g$) rate 1114. "Lazy" producers 1118 may have hidden potential for workover opportunities.

"Lag high gas" producers 1120 are characterized by having an above average gas production ($q_g$) rate 1114. "Lag high gas" producers 1120 also have a below average oil production ($q_o$) rate 1110 and water production ($q_w$) rate 1112. "Lag high gas" producers 1120 can be gas wells or may have a perforation zone near the gas cap. Expansion of gas cap and/or depletion of oil zone may have changed the gas-oil contact level. Gas coning near the well may also contribute to the gas surplus.

"Lag high water" producers 1122 are characterized by having an above average water production ($q_w$) rate 1112, while maintaining a below average oil production ($q_o$) rate 1110 and gas production ($q_g$) rate 1114. "Lag high water" producers 1122 may have water coning/channeling problems. The high water rates in "lag high water" producers 1122 may also be caused by a change in the water-oil contact due to waterflooding.

"Troublesome" producers 1124 are characterized by having an above average water production ($q_w$) rate 1112 and gas production ($q_g$) rate 1114, while maintaining a below average oil production ($q_o$) rate 1110. "Troublesome" producers are challenging workover projects. Depending on the risk factor and reward expectancy, "troublesome" producers 1124 could be candidates for production termination.

As an alternative to under-performing producers 1116, superior producers 1126 are characterized by oil production ($q_o$) rate 1110 above the average producer. Similar to under-performing producers 1116, superior producers 1126 can be divided into 4 subgroups.

"Perfect" producers 1128 are characterized by having an above average oil production ($q_o$) rate 1110, while their water production ($q_w$) rate 1112, and gas production ($q_g$) rate 1114 remain below average. Typically, "perfect" producers 1128 require less attention and oversight from an engineer than do other personality types.

"Lead high gas" producers 1130 are characterized by having an above average oil production ($q_o$) rate 1110 and gas production ($q_g$) rate 1114 while maintaining a below average water production ($q_w$) rate 1112. It is possible that "lead high gas" producers 1130 may be receiving injected gas from nearby injection activity.

"Lead high water" producers 1132 are characterized by having an above average oil production ($q_o$) rate 1110 and water production ($q_w$) rate 1112 while maintaining a below average gas production ($q_g$) rate 1114. Nearby water injectors with strong injection activity may have direct communication channels with "lead high water" producers 1132, causing the increased water production ($q_w$) rate 1112.

"Hyperactive" producers 1134 are characterized by having an above average oil production ($q_o$) rate 1110, water production ($q_w$) rate 1112, and gas production ($q_g$) rate 1114. Further investigation of "hyperactive" producers 1134 may provide valuable understanding in field operations.

Referring now to FIG. 12, an expanded personality analysis for injection wells is shown according to an illustrative embodiment. FIG. 12 is a personality analysis using only injector wells and 2 injection variables (water injection ($i_w$) rate 1210, and gas injection ($i_g$) rate 1212). From the combination of the previous 2 variables, 4 injector personalities are generated, which are summarized in FIG. 12.

Weak injectors inject water and gas at rates below the average injection rates, while strong injectors inject water and gas above the average injection rates. Combinations of weak and strong injectors can also exist. For example, if water injection ($i_w$) rate 1210 is below average and gas injection ($i_g$) rate 1212 is above average, these injector wells are identified as "lag $w_{inj}$ lead $g_{inj}$" 1214. On the other hand, "lead $w_{inj}$ and lag $g_{inj}$" 1214 indicate an above average water injection ($i_w$) rate 1210 and below average gas injection ($i_g$) rate 1212.

The previous expanded personality analysis for injection wells (FIG. 12) can be further simplified when only either water or gas is being injected into the reservoir (i.e. waterflooding or gas injection operation).

Finally, when combining the results from personality analysis for producing wells (FIG. 1) and the results from personality analysis for injection wells (FIG. 12) several scenarios for engineering interpretation/optimization are generated. The different scenarios can be better visualized if both results are superimposed on a unique map.

Figure 13:
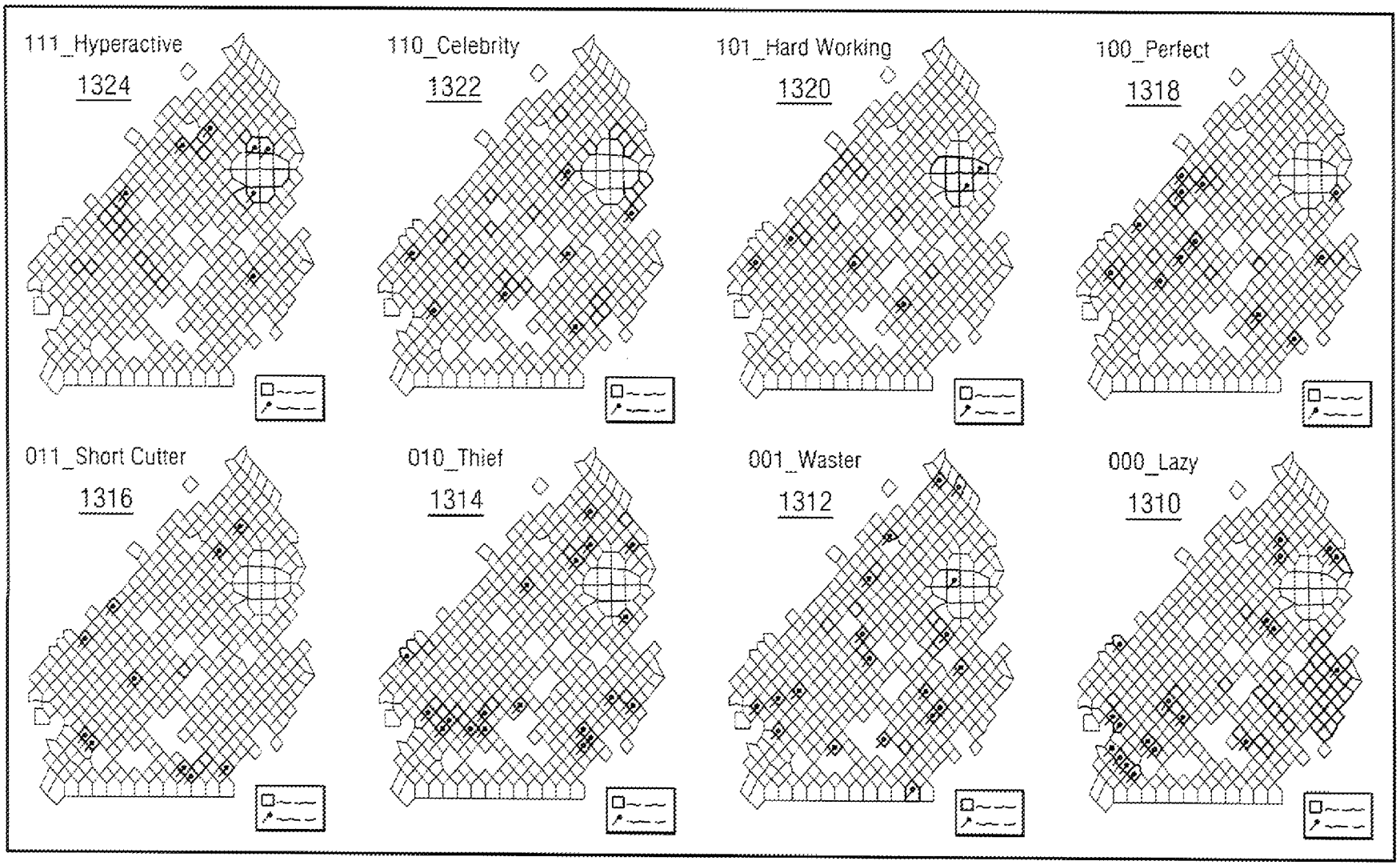
FIG. 13 is a macro application of Performance Model at pattern level according to an illustrative embodiment.

Referring now to FIG. 13, a macro application of Performance Model at pattern level is shown according to an illustrative embodiment. FIG. 13 shows the results of Performance Model at pattern level in an example field using only 3 variables (oil production ($q_o$) rate, water production ($q_w$) rate, and water injection ($i_w$) rate). FIG. 13 represents the simplified field performance characterized by the different pattern personalities for a specific time period.

FIG. 13 utilizes the same simplified pattern personality analysis of FIG. 9 where: "000_Lazy" 1310 is comprised of those patterns having first pattern personality 910 of FIG. 9, "001_Waster" 1312 is comprised of those patterns having second pattern personality 912 of FIG. 9, "010_Thief" 1314 is comprised of those patterns having third pattern personality 914 of FIG. 9, "011_Short Cutter" 1316 is comprised of those patterns having fourth pattern personality 916 of FIG. 9, "100_Perfect" 1318 is comprised of those patterns having fifth pattern personality 918 of FIG. 9, "101_Hard Working" 1320 is comprised of those patterns having sixth pattern personality 920 of FIG. 9, "110_Celebrity" 1322 is comprised of those patterns having seventh pattern personality 922 of FIG. 9 and "111_Hyperactive" 1324 is comprised of those patterns having eighth pattern personality 924 of FIG. 9.

In this specific field example, FIG. 13 shows that many "000_Lazy" 1310 patterns or non-responsive injection areas are concentrated in the South East side. These identified areas represent opportunities for production optimization either through increase in injection or through workover operations (i.e. stimulation on producers). Additional evaluations are possible based on the distribution of the remaining pattern personalities.

Referring now to FIGS. 14-29, a detailed discussion of Meta Patterns analysis technique is described. Meta Patterns technology is based on Moving Domain Analysis. The major alteration to classic Moving Domain Analysis consisted of modifying the shape of the Moving Domain from the typical circular patterns used in classic Moving Domain Analysis to ellipses. This is then used for identification of areas in the flood where "natural patterns", or Meta Patterns, exist.

Geometric waterflood patterns may be interconnected within neighboring areas in such a way that they behave as if they are one large natural pattern or area. By modifying the orientation or angle of the elliptical moving domains used in the analysis technique, Meta Patterns can potentially give an indication of major preferences of the direction of fluid flow for injected or produced fluids.

The history of the flood is divided into even time increments, then the over- and under-performing areas are identified for each time interval using various performance indicators. The individual time intervals for the flood history are then integrated to give a complete chronology of reservoir performance from the beginning of the flood to present. From this data, possible areas of infill potential may be approximated as well as opportunities for modifying water injection to increase recovery.

Classic waterflood analysis involves using specific configurations of injection and production wells repeated across the field (i.e. regular four spot, five spot, etc.). These types of patterns are called geometric flood patterns. Classic waterflood analysis also involves pre-assigning geometric factors to the wells inside the geometric patterns to account for their particular production/injection contribution. While this assumption can be correct for homogeneous (ideal) and isotropic reservoirs, real reservoirs are heterogeneous and assumption like this could lead to incorrect production/injection analysis, especially in carbonate formations.

The Meta Pattern technique was developed in order to eliminate the limitations associated with carrying out production/injection analysis using pre-set specific configurations of injectors and producers, which indirectly uses also pre-set geometric factors. This technique identifies groups of injector and producer wells with similar characteristics and which can therefore be optimized as a "natural pattern".

A detailed description of Meta Pattern analysis and results is presented below. A Field example containing production and injection history on a well basis is chosen. The type of reservoir is a carbonate formation. Moving domain is run using an ellipse shape (3 times longer than wider) and two different angles (45° and 135° degrees). These two angles are the original flood design angles for the field example.

Figure 14:
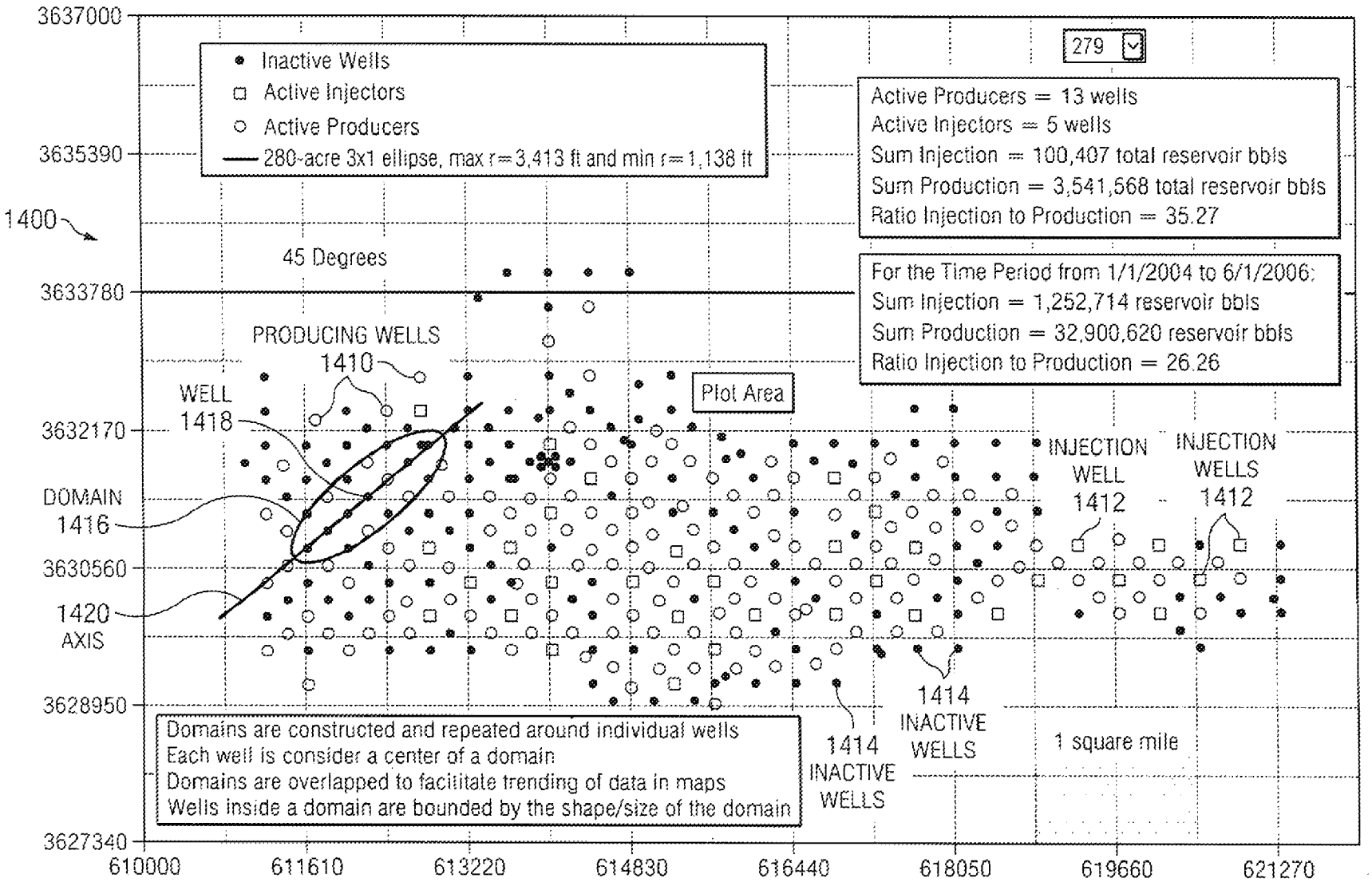
FIG. 14 is a schematic of the domains at the first flood design angle according to an illustrative embodiment.
Figure 15:
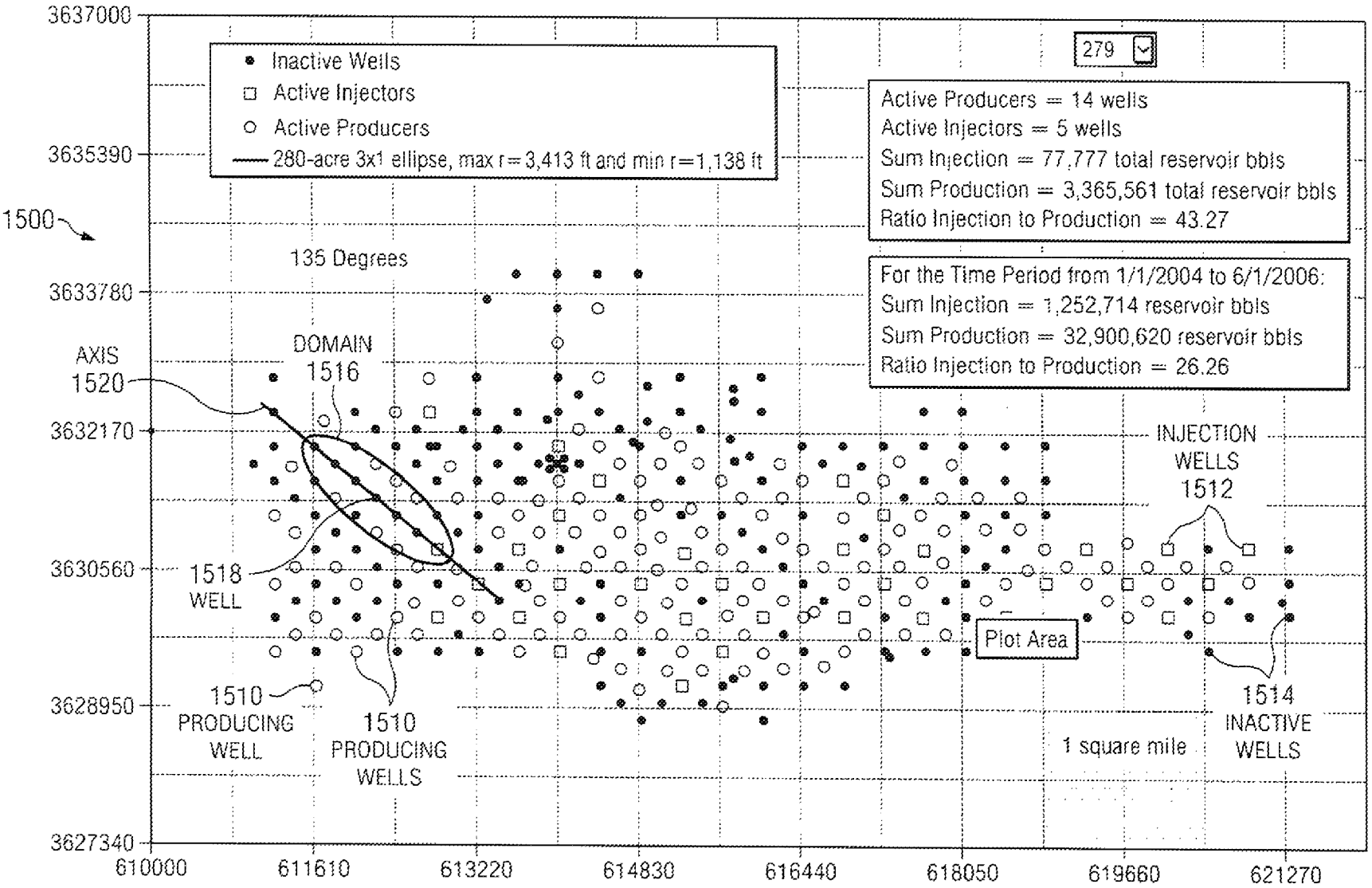
FIG. 15 is a schematic of the domains at the second flood design angle according to an illustrative embodiment.

As shown by FIG. 14 and FIG. 15, domains which consist of a group of wells, are constructed and repeated around each individual well. Each well, producer or injector is considered a center of a domain. Domains are overlapped to facilitate trending of data in maps. The wells included in a particular domain are bounded by the elliptical shape and size of the domain.

Referring now to FIG. 14, a schematic of the domains at the first flood design angle is shown according to an illustrative embodiment. Field 1400 is a graphical representation of a field, with various wells shown therein. For this particular field the first flood design angle is 45°. While the schematic shows a flood design angle of 45°, this is for illustrative purposes only. Any first angle could be chosen for the flood design angle.

Producing wells 1410 are wells within field 1400 at which active production is taking place. Injection wells 1412 are wells within field 1400 at which gasses or liquids are being injected into the reservoir. In mature oilfields these injections are necessary to maintain reservoir pressure and improve production at producing wells 1410. Inactive wells 1414 are wells within field 1400 which initially were either producing wells 1410 or injection wells 1412 but are no longer active.

As an illustrative example to show how the domains at the first flood design angle are constructed is presented below. Domain 1416 is constructed using well 1418 as the center of the domain 1416. Domain 1416 is oriented along axis 1420 (45°). Domain 1416 includes well 1418 and any other well bounded by the selected size and shape of domain 1416. Additional domains are then constructed around each of the other wells within field 1400.

Referring now to FIG. 15, a schematic of the domains at the second flood design angle is shown according to an illustrative embodiment. Field 1500 is a graphical representation of a field, with various wells shown therein. Field 1500 is field 1400. Axis 1420 of FIG. 14 has been reoriented to axis 1520. The wells encompassed by domain 1516 are therefore different from those wells encompassed by domain 1416 of FIG. 14. For this particular field the second flood design angle is 135°. While the schematic shows a flood design angle of 135°, this is for illustrative purposes only. Any first angle could be chosen for the flood design angle. In one illustrative embodiment, the second flood design angle is chosen to be orthogonal to the first flood design angle.

Producing wells 1510 of FIG. 15 are the same producing wells 1410 of FIG. 14. Injection wells 1512 of FIG. 15 are the same injection wells 1412 of FIG. 14 and finally, inactive wells 1514 of FIG. 15 are the same inactive wells 1414 of FIG. 14.

As an illustrative example to show how the domains at the second flood design angle are constructed is presented below. Domain 1516 is constructed using well 1518 as the center of the domain 1516. Domain 1516 is oriented along axis 1520 (135°). Domain 1516 includes well 1518 and any other well bounded by the selected size and shape of domain 1516. Additional domains are then constructed around each of the other wells within field 1500.

Referring now to FIG. 16, a sample of the domains for each flood design angle is shown according to an illustrative embodiment Domains 1610 contain a sample of the domains created using the 45° axis orientation (axis 1420 of FIG. 14). Domains 1620 contains a sample of the domains created using the 135° axis orientation (axis 1520 of FIG. 15).

Since each of domains 1416 (45°) overlap with others of domains 1416 and domains 1516 (135°) overlap with others of domains 1516, one specific well, such as well 1418 of FIG. 14 is contained in several of the individual domains of domains 1416 and domains 1516. Wells contained in each domain do not vary with time. For simplicity, these domains can be called pattern. Nevertheless these domains are not geometric patterns with fixed number of injectors and producers.

Parallel to the creation of domains for each specific angle, the production and injection history of the flood is divided into even time increments (periods); variables such as cumulative fluid production (oil, water and gas), cumulative fluid injection (water and gas injection), oil cut and water cut as well as production indicators such as "Oil Processing Ratio" (OPR) and "Voidage Replacement Ratio" (VRR) are set-up for each specific period. Below are the definitions of the main production indicators used in Meta Patterns technique:

$$OPR=[\text{Cumulative oil production}/\text{Cumulative fluid injection}/100]_{period} \quad \text{Equation 4}$$

$$VRR=[\text{Cumulative fluid injection}/\text{Cumulative fluid production}]_{period} \quad \text{Equation 5}$$

where:

OPR is Oil Processing Ratio for a specific period.

VRR is Voidage Replacement Ratio for a specific period.

Referring now to FIG. 17, a sample database of production/injection for various domains at the first flood design angle is shown according to an illustrative embodiment. FIG. 17 contains production/injection information for domains 1416 of FIG. 14 over each time period into which the flood history is divided. A similar database can be constructed for the second flood design angle.

Domains 1710 have values for either cumulative fluid production or cumulative fluid injection over each time period into which the flood history is divided. Database 1700 includes production and injection variables over each specified time period such as, but not limited to, oil production 1712, water production 1714, gas production 1716, total fluid production 1718, gas injection 1720, CO2 injection 1722, water injection 1724, and total fluid injection 1726.

From these production and injection variables, an Oil Processing (OPR) 1728 and a "Voidage Replacement Ratio" (VRR) 1730 can be calculated and set-up for each specific time period using equations 4 and 5.

Using the two sets of created domains 1416 of FIG. 14 and domains 1516 of FIG. 15, and the previously calculated production/injection variables, only the patterns that have values for cumulative fluid production and cumulative fluid injection are considered for each time interval. Oil Processing Ratio and Voidage Replacement Ratio calculations at reservoir conditions are more representative of fluid flow in the reservoir.

Referring now to FIG. 18, a sample database correlating domains to specific domain centers is shown according to an illustrative embodiment. Domains 1810 in the database 1800 include domains 1416 of FIG. 14. Production and injection values 1820 are the same values of FIG. 17.

As shown in FIG. 18, each of the domains 1810 is associated to its corresponding pattern center 1830 taking into account the orientation of the pattern axis, such as axis 1420 of FIG. 14. All the production and injection values 1820 of FIG. 18 correspond to each specific domain. Nevertheless, for grid mapping purposes, production and injection values 1820 are they will be temporary assigned to the well centers of each corresponding domain.

Figure 19:
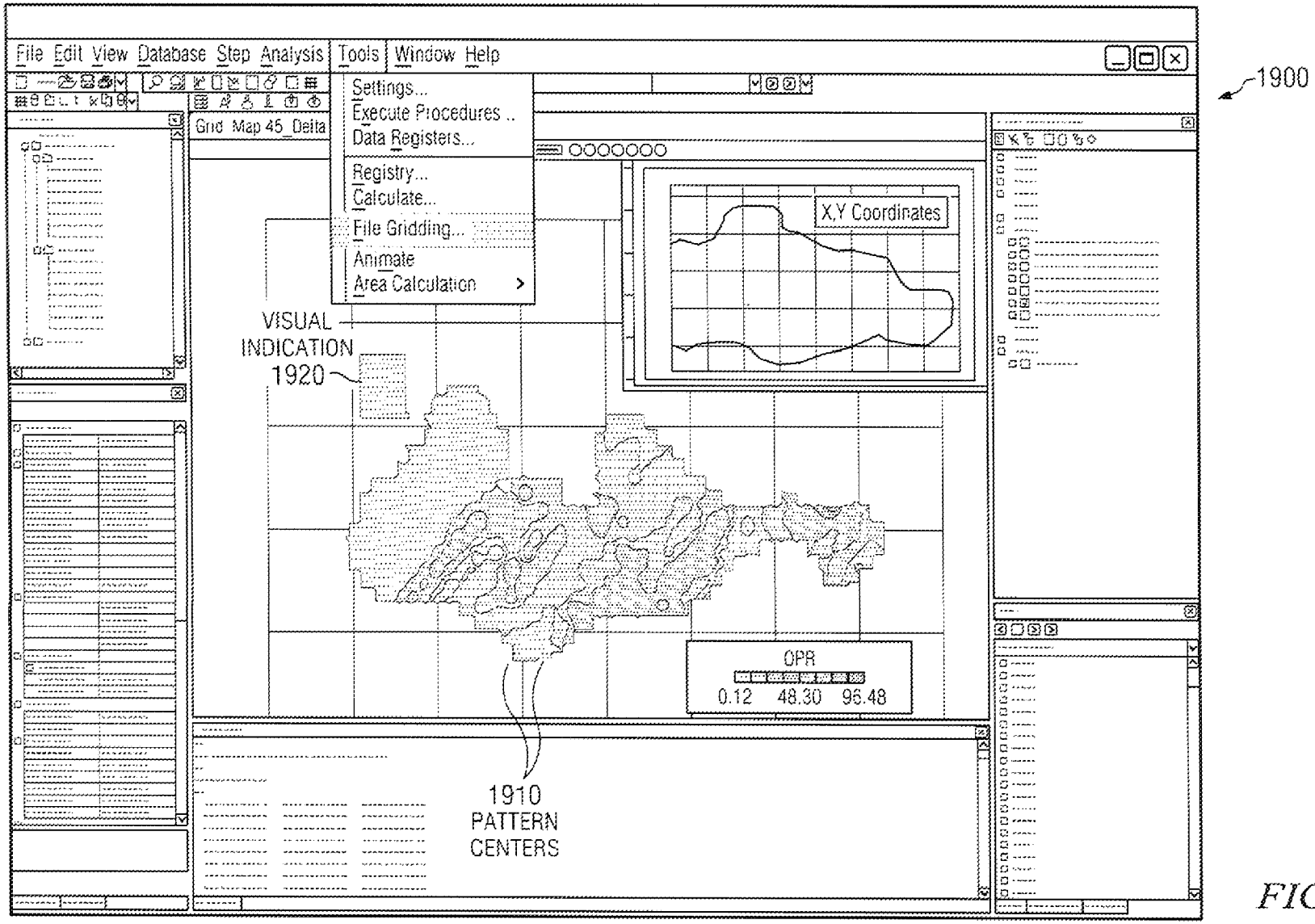
FIG. 19 is a grid map of Oil Processing Ratio at a specific angle and time period according to an illustrative embodiment.

Referring now to FIG. 19, a grid map of Oil Processing Ratio at a specific angle and time period is shown according to an illustrative embodiment. The grid map of FIG. 19 is composed of the Oil Processing Ratio values at a specific angle and time period for each of the pattern centers, such as pattern centers 1830 of FIG. 18.

Grid map 1900 of FIG. 19 can be created in a production analysis and surveillance software, such as for example Oil-Field Manager®, available from Schlumberger Technology Corporation. Grid maps similar to that of FIG. 19 can be prepared for other variables such as "Voidage Replacement Ratio", oil cut and water cut for each specific orientation of the pattern axis, such as axis 1420 of FIG. 14, and for each specific time period.

Pattern centers 1910 include producing wells, injection wells and inactive wells, such as producing wells 1410, injection wells 1412 and inactive wells 1414 of FIG. 14. Surrounding each pattern centers 1910 is a visual indication 1920 which represents interpolated values between each pattern centers 1910. By plotting a visual indication 1920 for each of the pattern centers 1910, an overall field view of the Oil Processing Ratio can be seen.

Referring now to FIG. 20, a database representing several grid maps into a unique Cartesian coordinate system is shown according to an illustrative embodiment. Grid maps of Oil Processing Ratio, Voidage Replacement Ratio, oil cut and water cut for each specific angle and specific time period are translated into a unique Cartesian coordinate system. For example, grid map 1900 of Oil Processing Ratio of FIG. 19 is exported using the X, Y coordinates 2010.

FIG. 20 also shows the time periods 2020 into which the flood history is divided for this particular field example. Database 2000 of FIG. 20 includes specific values for production indicators 2030 such as Oil Processing Ratio, Voidage Replacement Ratio, oil cut and water cut. FIG. 20 is also the auxiliary database for the visualization software called Spotfire®, available from Tibco Software Inc.

Figure 21:
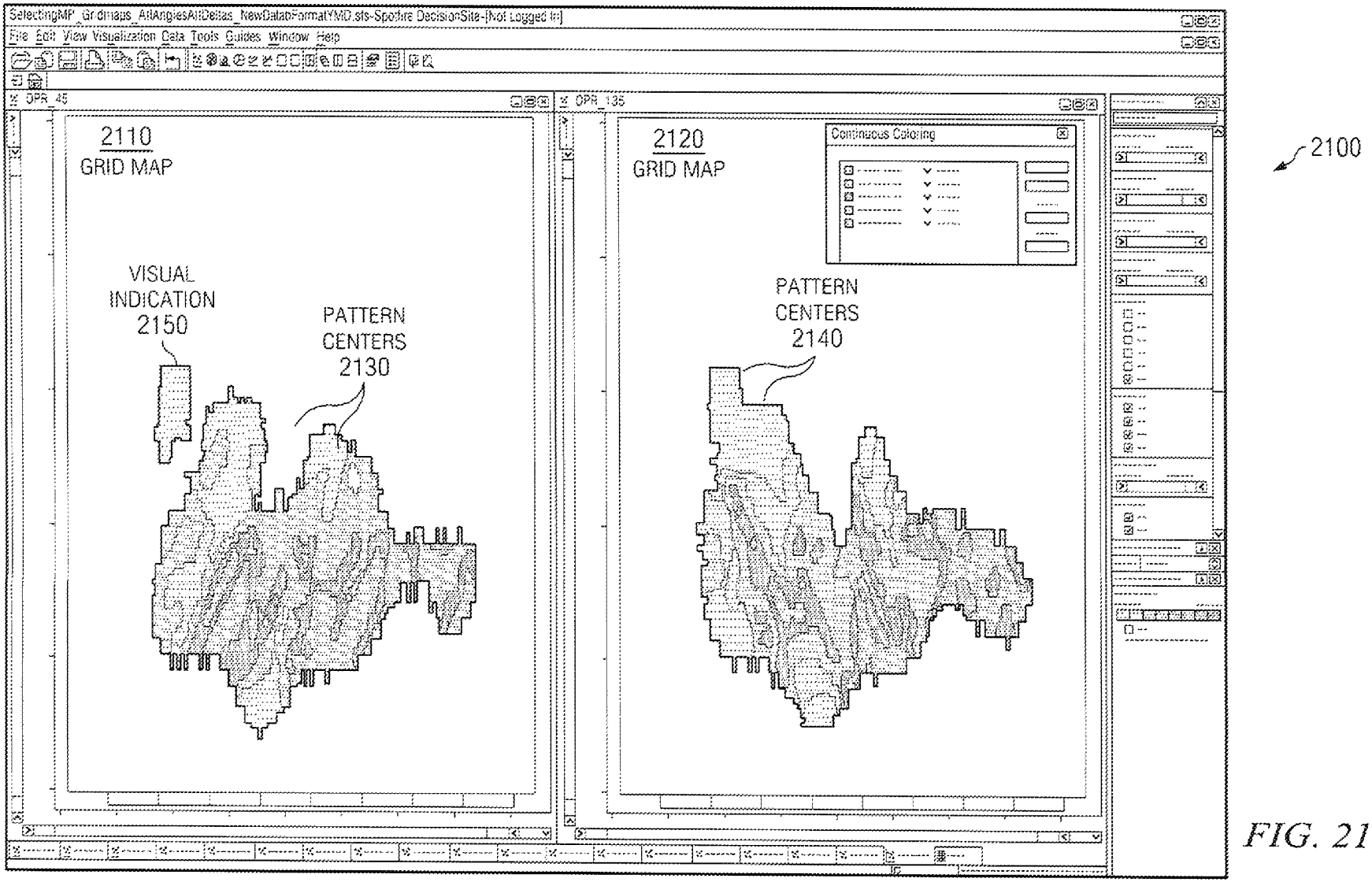
FIG. 21 is a series of grid maps of "Oil Processing Ratio" for each of the flood design angles according to an illustrative embodiment.

Referring now to FIG. 21, is a series of grid maps of Oil Processing Ratio for each of the flood design angles is shown according to an illustrative embodiment. Series 2100 includes grid map 2110 and grid map 2120 that are created in the visualization software using the Cartesian coordinates, time periods, and production indicators of FIG. 20. Grid map 2110 is obtained for the first specific orientation of the pattern axis, such as axis 1420 of FIG. 14. Grid map 2120 is obtained for the second specific orientation of the pattern axis, such as axis 1520 of FIG. 15.

Grid maps similar to that of FIG. 21 can be prepared for other variables such as "Voidage Replacement Ratio", oil cut and water cut for each specific orientation of the pattern axis, such as axis 1420 of FIG. 14, and for each specific time period.

Pattern centers 2130 and pattern centers 2140 include producing wells, injection wells and inactive wells, such as producing wells 1410, injection wells 1412 and inactive wells 1414 of FIG. 14. Surrounding either pattern centers 2130 or pattern centers 2140 is a visual indication 2150 which represents interpolated values between each corresponding pattern centers. By plotting a visual indication 2150 for each of the pattern centers 2130 or "pattern centers 2140, an overall field view of the Oil Processing Ratio can be seen.

In order to evaluate the Oil Processing Ratio for a specific area, an additional variable called Oil Processing Ratio Strength Indicator (OPR SI) is calculated. Oil Processing Ratio Strength Indicator is defined as follows:

$$\text{OPR SI}=[\text{OPR } 45°/\text{OPR } 135°]_{\textit{same X, Y coordinates}} \qquad \text{Equation 6}$$

where:

OPR 45° is Oil Processing Ratio at 45° for each specific X, Y coordinates; and

OPR 135° is Oil Processing Ratio at 135° for each specific X, Y coordinates.

Figure 22:
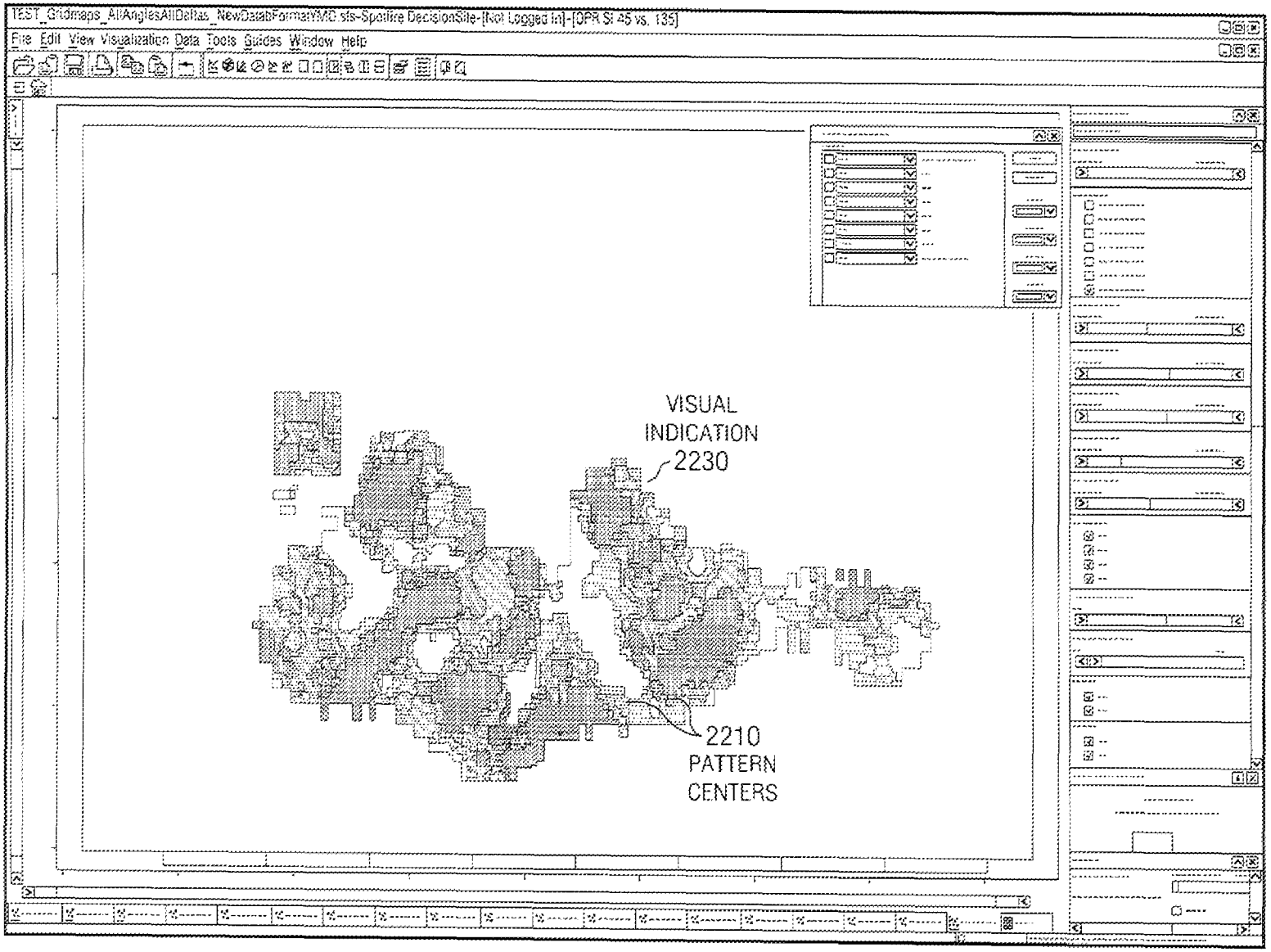
FIG. 22 a grid map of the Oil Processing Ratio Strength Indicator according to an illustrative embodiment.

Referring now to FIG. 22, a grid map of the Oil Processing Ratio Strength Indicator is shown according to an illustrative embodiment. Grid map 2200 shows pattern centers 2210 that include producing wells, injection wells and inactive wells, such as producing wells 1410, injection wells 1412 and inactive wells 1414 of FIG. 14. Surrounding each pattern centers 2210 is a visual indication 2230 that represents calculated values using Equation 6. By plotting a visual indication 2230 an overall field view of the Oil Processing Ratio Strength Indicator can be seen.

Areas where the value of Oil Processing Ratio Strength Indicator is near 1 indicate that the value for Oil Processing Ratio at the first orientation (i.e. grid map 2110 of FIG. 21) is very similar to the value of Oil Processing Ratio at the second orientation (i.e. grid map 2120 of FIG. 21). In these areas, there is no preferential direction of the Oil Processing Ratio in any of the particular angles. That is, there is a good bi-directional flow. Therefore, the Oil Processing Ratio is more independent of the specific angles chosen to create the domains. These types of areas are therefore more stable and can be "natural patterns".

Referring now to FIGS. 23-26, grid maps of the Oil Processing Ratio Strength Indicator with different adjustments over different time periods are shown according to an illustrative embodiment.

Figure 23:
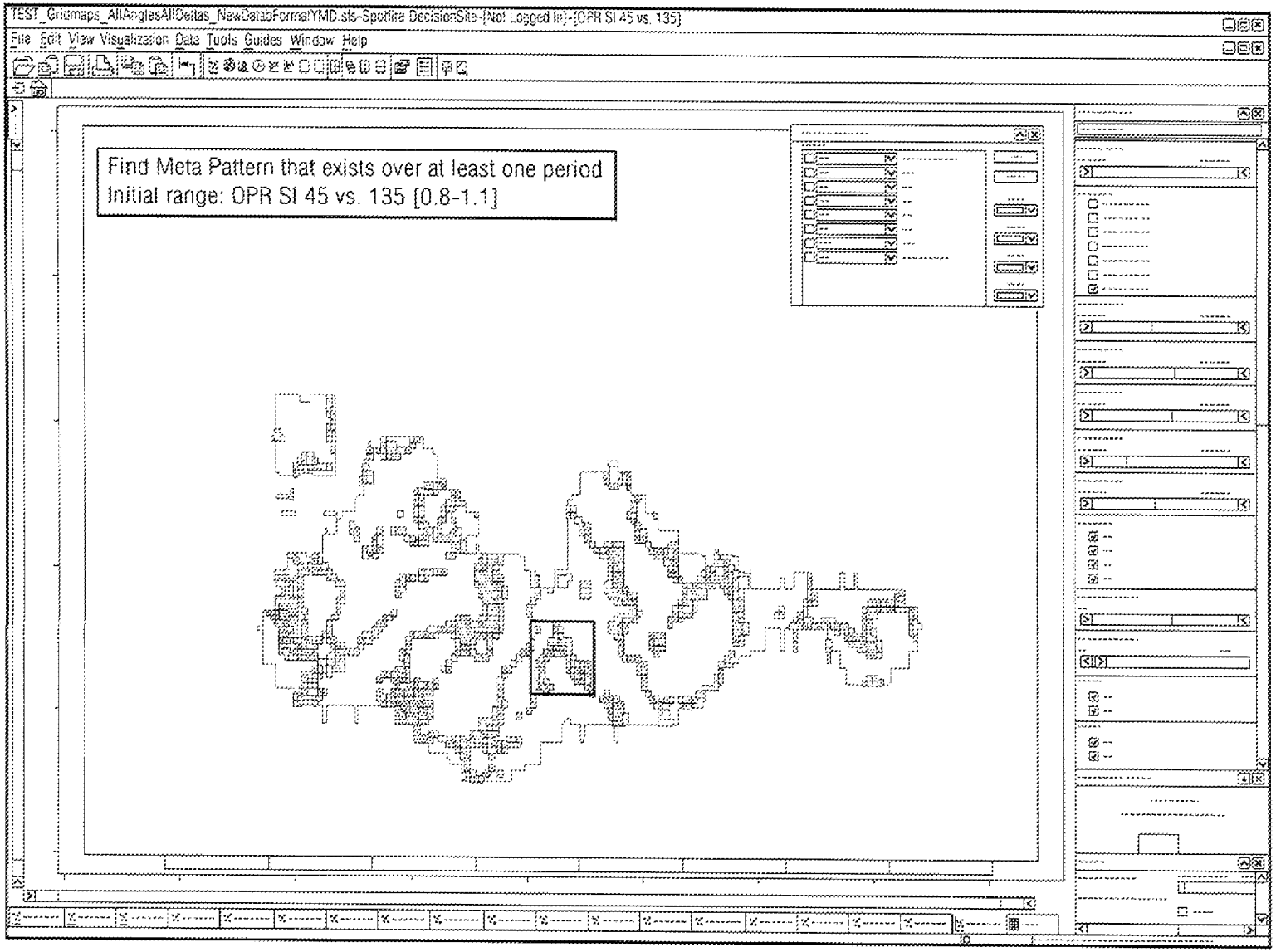
FIG. 23 is a grid map of the initial Oil Processing Ratio Strength Indicator adjustment over a first time period according to an illustrative embodiment.

In order to find a Meta Pattern or a "natural patterns", initially the range for the Oil Processing Ratio Strength Indicator is set close to 1 and it is further adjusted to maintain a similar area over at least two consecutive time periods Referring now specifically to FIG. 23, grid map of the initial Oil Processing Ratio Strength Indicator adjustment over a first time period is shown according to an illustrative embodiment. Grid map 2300 of FIG. 23 has an "Oil Processing Ratio Strength Indicator range between 0.8 and 1.1.

Figure 24:
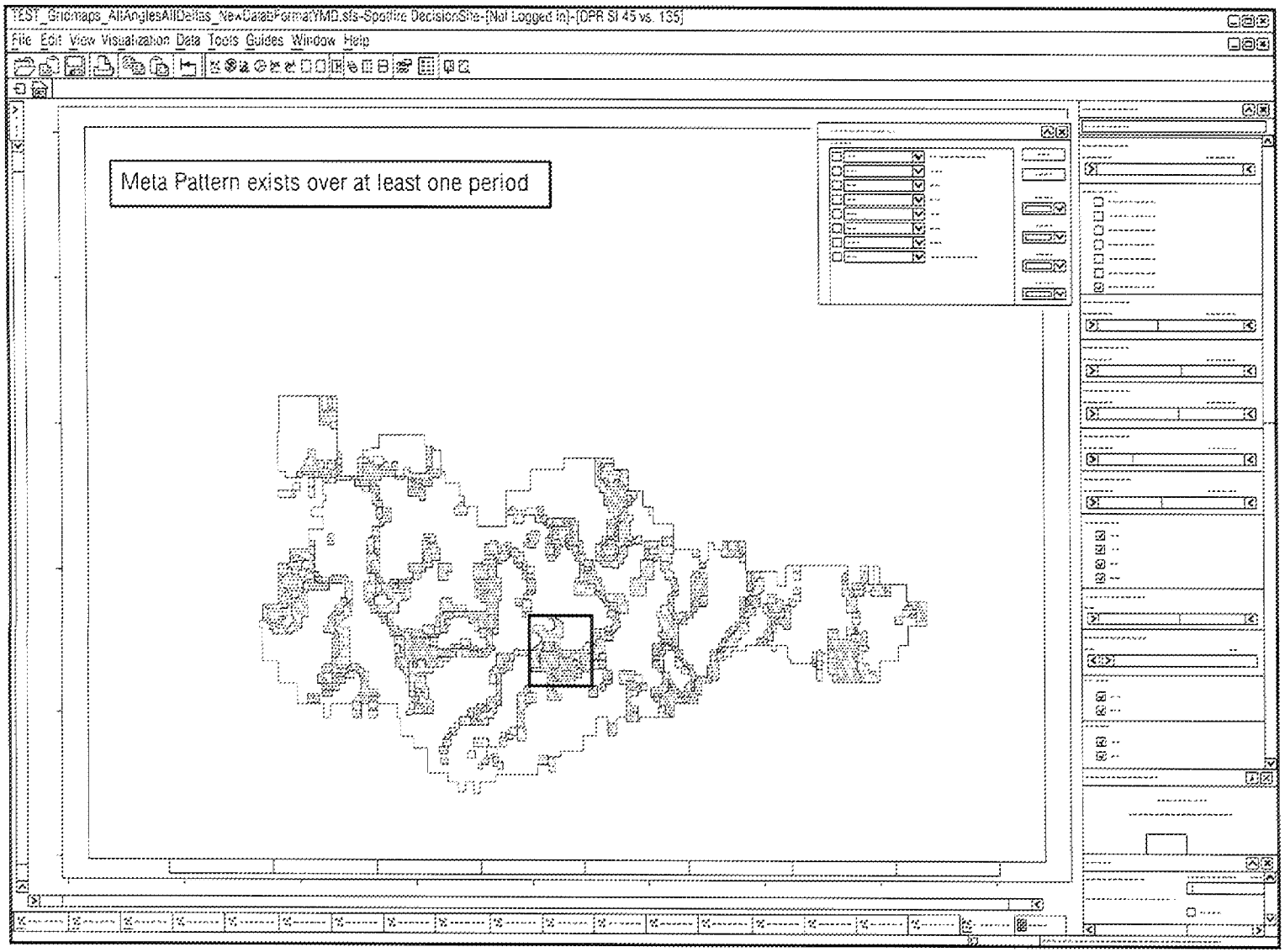
FIG. 24 is a grid map of the initial Oil Processing Ratio Strength Indicator adjustment over a second time period according to an illustrative embodiment.

Referring now specifically to FIG. 24, a grid map of the initial Oil Processing Ratio Strength Indicator adjustment over a second time period is shown according to an illustrative embodiment. The second time period is immediately previous to the first time period depicted in FIG. 23. Grid map 2400 of FIG. 24 has an Oil Processing Ratio Strength Indicator range between 0.8 and 1.1.

The grid maps of FIGS. 23 and 24 are then compared to identify any potential Meta Pattern or similar area that exists over two consecutive periods. If no Meta Pattern is identified, then the Oil Processing Ratio Strength Indicator range can be expanded to include more loosely correlated areas within the field.

Figure 25:
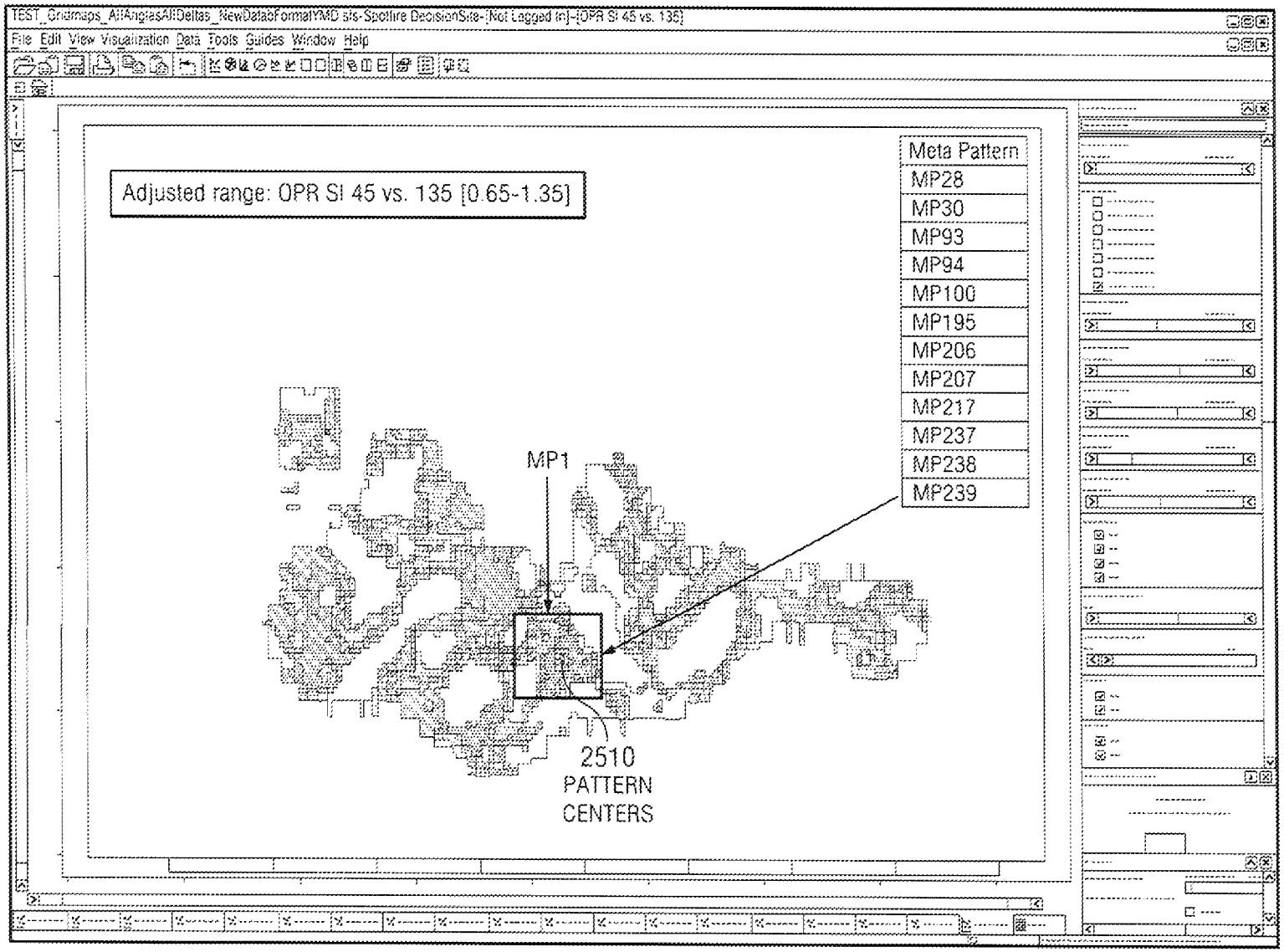
FIG. 25 is a grid map of the final Oil Processing Ratio Strength Indicator adjustment over a first time period according to an illustrative embodiment.

Referring now specifically to FIG. 25, a grid map of the final Oil Processing Ratio Strength Indicator adjustment over a first time period is shown according to an illustrative embodiment. Grid map 2500 of FIG. 25 has an Oil Processing Ratio Strength Indicator range between 0.65 to 1.35.

Figure 26:
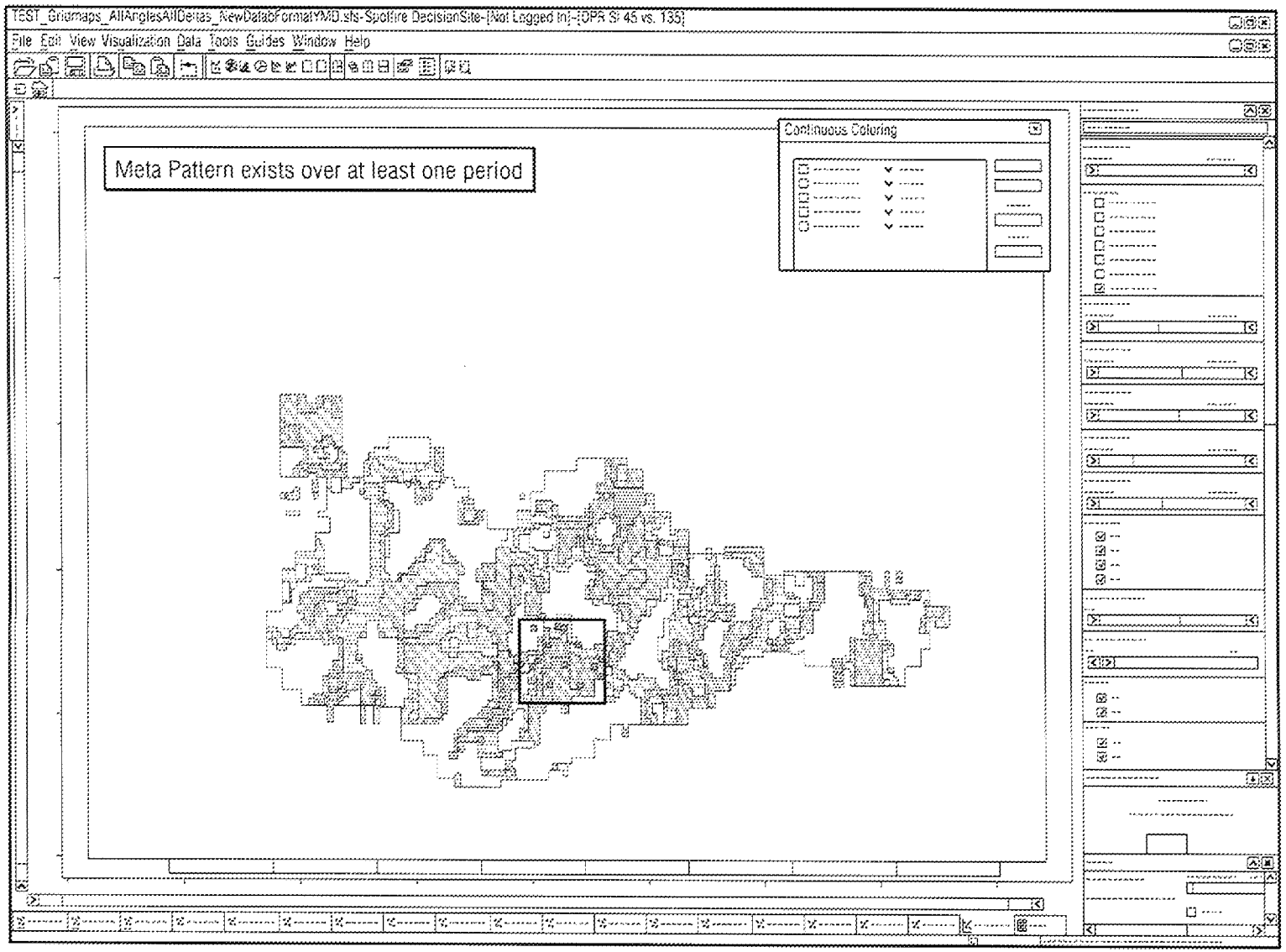
FIG. 26 is a grid map of the final Oil Processing Ratio Strength Indicator adjustment over a second time period according to an illustrative embodiment.

Referring now specifically to FIG. 26, a grid map of the final Oil Processing Ratio Strength Indicator adjustment over a second time period is shown according to an illustrative embodiment. The second time period is immediately previous to the first time period depicted in FIG. 25. Grid map 2600 of FIG. 26 has an Oil Processing Ratio Strength Indicator range between 0.65 to 1.35.

From the comparison of FIG. 25 and FIG. 26, there is an area with an obvious trend in the south of the sample field that is maintained for more than one period. This specific area is called a Meta Pattern, for this specific example Meta Pattern 1 (MP1). Since FIG. 25 is a grid map at pattern level with values assigned to pattern centers, pattern centers inside the Meta Pattern 1 are identified. Approximately, these pattern centers were the ones that generated the original grid maps as the one shown in FIG. 19. FIG. 25 also shows a list of the pattern centers 2510 inside Meta Pattern 1. Each pattern center 2510 is correlated back to its corresponding domain creating different well lists.

Figure 27:
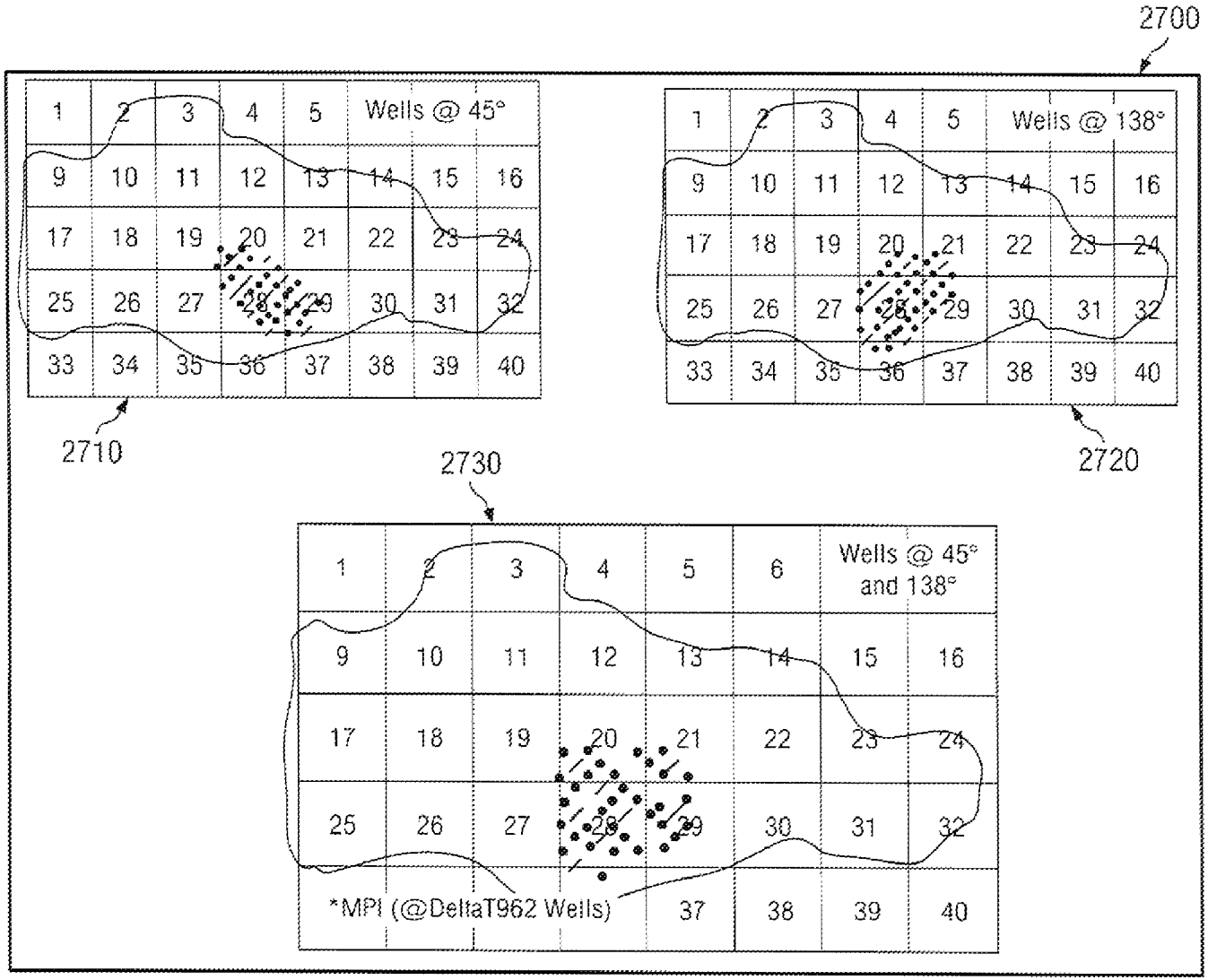
FIG. 27 are different well lists according to an illustrative embodiment.

Referring now to FIG. 27, different well lists are shown according to an illustrative embodiment. List series 2700 includes two different lists of wells. Well list 2710 includes the wells from domain 1416 of FIG. 14. That is, well list 2710 corresponds to the 45°. Well list 2720 includes the wells from domain 1516 of FIG. 15. That is, well list 2720 corresponds to the flood design angle of 135°. Unified well list 2730 includes both the wells from domain 1416 of FIG. 14 and 1516 of FIG. 15. In order to focus the evaluation on the most recent time period, it is necessary to remove inactive wells, such as inactive wells 1414 of FIG. 14 or inactive wells 1514 of FIG. 15 to create a depurated list of wells.

Figure 28:
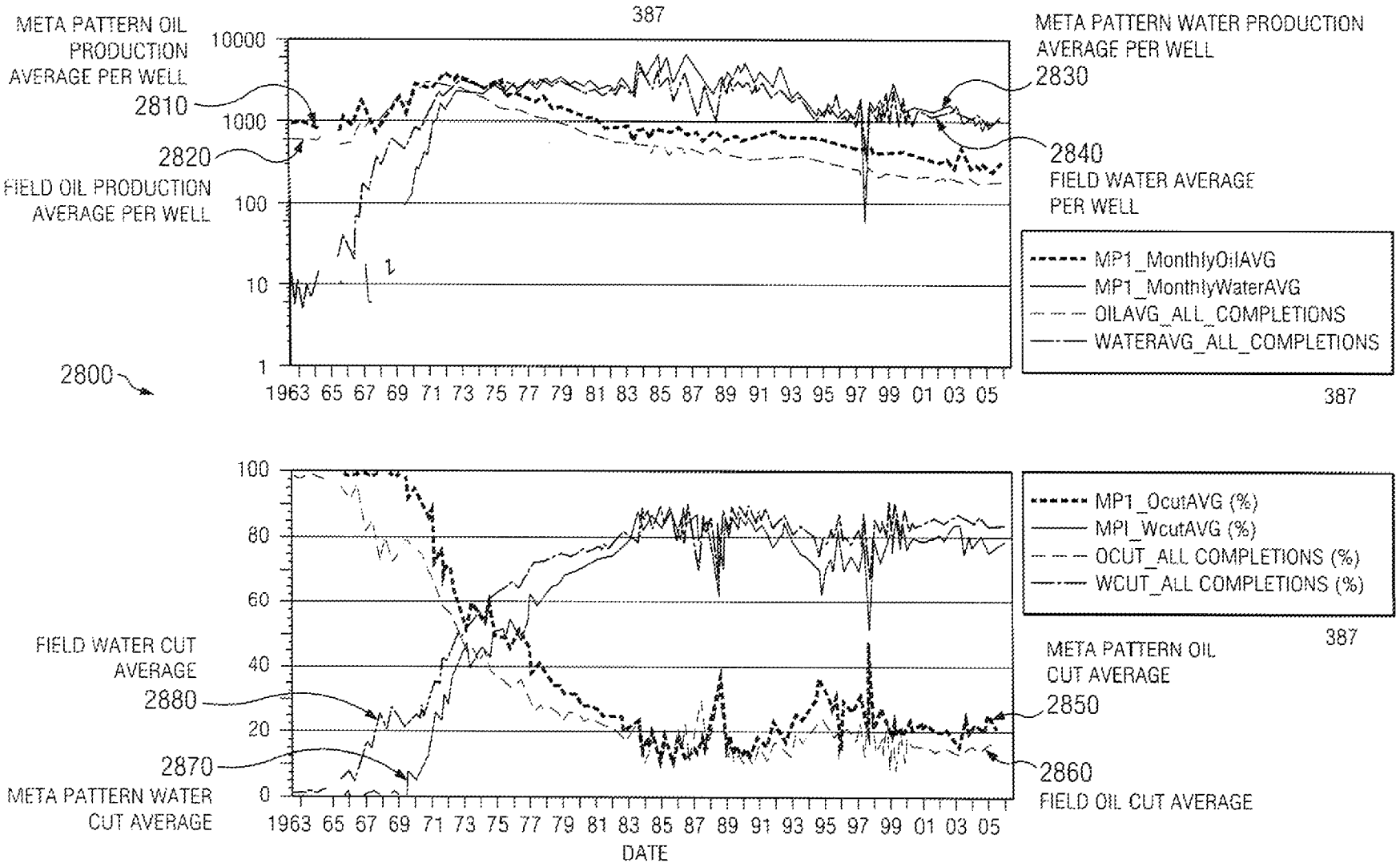
FIG. 28 is a schematic of production within an identified Meta Pattern versus average production within the field according to an illustrative embodiment.

Referring now to FIG. 28, a schematic of production within an identified Meta Pattern versus average production within the field is shown according to an illustrative embodiment. The production values plotted in Schematic 2800 are the production values for the depurated list of wells.

Schematic 2800 includes Meta Pattern Oil Production Average per well 2810 for the identified Metapattern (MP1). Schematic 2800 also includes Field Oil Production Average per well 2820 for the entire field. Similarly, schematic 2800 includes Meta Pattern Water Production Average per well 2830 for the identified metapattern. Schematic 2800 also includes Field Water Production Average Metapattern (MP1). Schematic 2800 also includes water production average per well 2840 for the entire field.

Schematic 2800 includes oil cut average 2850 for the identified Metapattern (MP1). Schematic 2800 also includes oil cut average 2860 for the entire field. Similarly, schematic 2800 includes water cut average 2870 for the identified Metapattern (MP1). Schematic 2800 also includes water cut average 2880 for the entire field.

Figure 29:
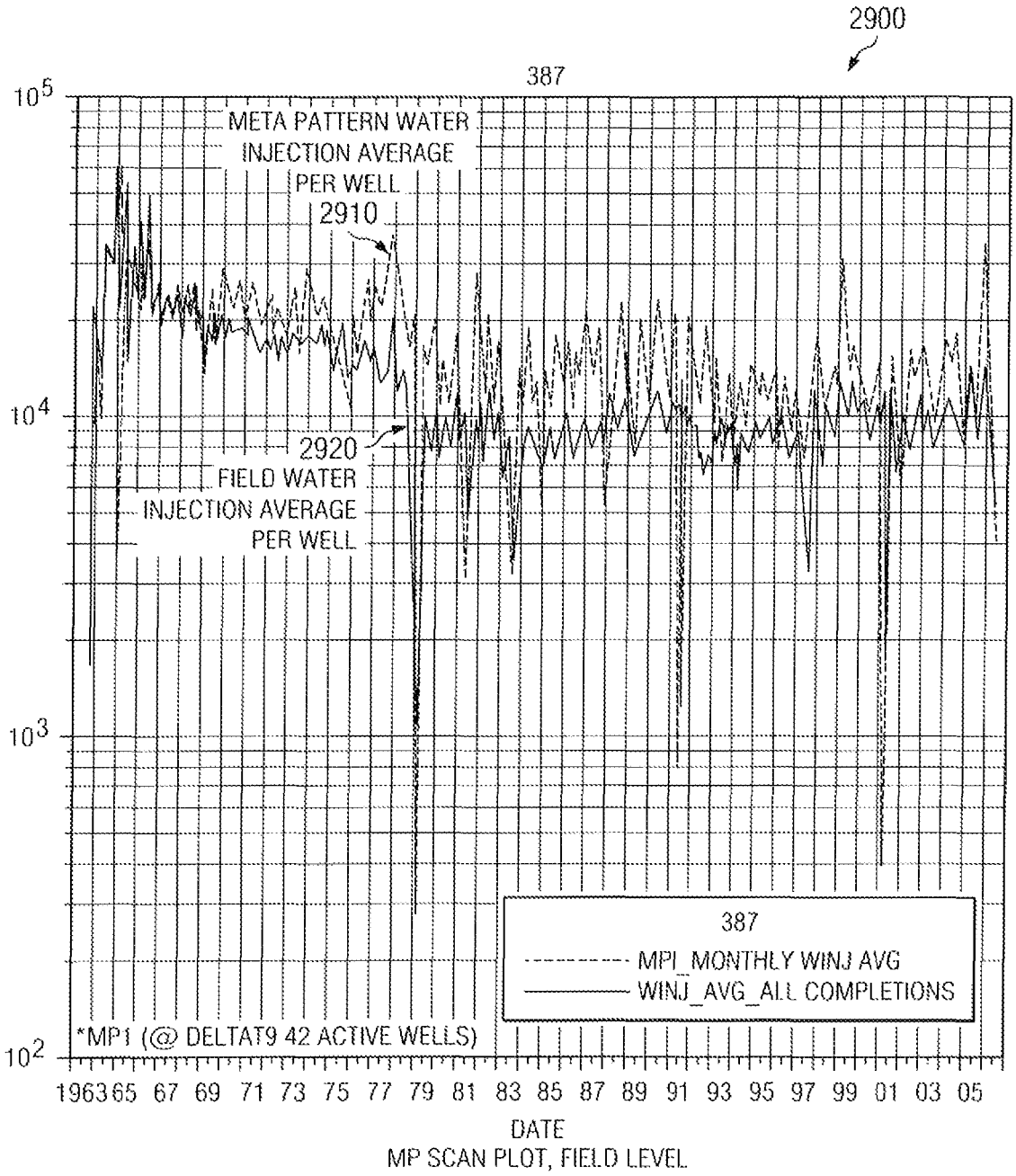
FIG. 29 is a schematic of injection within an identified Meta Pattern versus average injection within the field according to an illustrative embodiment.

Referring now to FIG. 29, a schematic of injection within an identified Meta Pattern versus average injection within the field is shown according to an illustrative embodiment. The injection values plotted in schematic 2900 are the injection values for the depurated lits of wells.

Schematic 2900 includes Meta Pattern Water Injection Average per well 2910 for the identified Metapattern (MP1). Schematic 2900 also includes Field Water Injection Average per well 2920 for the entire field.

The result shown in FIG. 28 and FIG. 29 indicate that an average well inside Meta Pattern 1 has a higher average monthly oil production, higher oil cut and higher average monthly water injection (FIG. 28 and FIG. 29); while maintaining a similar Oil Processing Ratio (OPR around 15) and higher Voidage Replacement Ratio (VRR>1.5) when compared to the field totals.

Due to the higher oil production and higher oil cut, an average well inside the identified Meta Pattern (MP1) will outperform an average well of the field. The identified Meta Pattern (MP1) is then recognized as a "natural pattern" that reacts well to the injection generating more production. The identified Meta Pattern (MP1) area may therefore be a potential candidate for infill drilling.

Thus the illustrative embodiments provide a method, system, and computer program product for performing oilfield surveillance operations. The oilfield has a subterranean formation with geological structures and reservoirs therein. The oilfield is divided into a plurality of patterns, with each pattern comprising a plurality of wells. Historical production/injection data is obtained for the plurality of wells. Two independent statistical treatments are performed to achieve a common objective of production optimization. The first statistical process is called Performance Model. In this first process, wells and/or patterns are characterized based on Heterogeneity Index results and personalities with the ultimate goal of field production optimization. The second statistical process is called Meta Patterns and applies particularly to waterflood scenarios. In this second process, the history of the flood is divided into even time increments. At least two domains for each of the plurality of wells are determined. Each of the at least two domains are centered around each of the plurality wells. A first domain of the at least two domains has a first orientation. A second domain of the at least two domains has a second orientation. An Oil Processing Ratio is determined for each of the at least two domains, then an Oil Processing Ratio Strength Indicator is calculated. At least one Meta Pattern within the field is then identified. An oilfield operation can then be guided based either on the well and/or pattern personality or the at least one Meta Pattern Although the foregoing is provided for purposes of illustrating, explaining and describing certain embodiments of the invention in particular detail, modifications and adaptations to the described methods, systems and other embodiments will be apparent to those skilled in the art and may be made without departing from the scope or spirit of the invention.

What is claimed is:

1. A method for optimizing production for a drilling operation in a field having a plurality of wells therein, the field having at least one well site with a drilling tool advanced into a subterranean formation with geological structures and reservoirs therein, the method comprising:

identifying a production history and an injection history for the plurality of wells;

determining a heterogeneity index value to each of the plurality of wells;

responsive to determining the heterogeneity index value to each of the plurality of wells, determining a pattern personality for each of the plurality of wells;

subdividing the production history and the injection history for the plurality of wells into a plurality of time intervals;

determining at least two domains for each of the plurality of wells wherein each of the at least two domains for each of the plurality of wells are centered around each of the plurality wells, wherein a first domain of the at least two domains has a first orientation, and wherein a second domain of the at least two domains has a second orientation;

determining an Oil Processing Ratio Strength Indicator for each of the at least two domains;

in response to determining an Oil Processing Ratio Strength Indicator for each of the at least two domains, determining at least one meta pattern within the field; and in response to determining the pattern personality for each of the plurality of wells and to determining the at least one meta pattern, guiding an oilfield operation based on the pattern personality for each of the plurality of wells and the at least one meta pattern.

2. The method for optimizing production of claim 1, wherein the heterogeneity index value is a quantitative comparison of production performance, injection performance, or combinations thereof, based on the production history and the injection history for the plurality of wells, and wherein each of the wells is located within at least one pattern inside the field, each of the at least one patterns including at least one of the plurality of wells.

3. The method for optimizing production of claim 1, wherein the pattern personality for each of the plurality of wells is determined from at least one of an injection rate for each of the plurality of wells relative to a pattern average injection rate and production rate for each of the plurality of wells relative to a pattern average production rate.

4. The method for optimizing production of claim 3, wherein the pattern personality for each of the plurality of wells is determined from a water injection rate for each of the plurality of wells relative to a pattern average water injection rate, an oil production for each of the plurality of wells relative to a pattern average oil production rate, and a water production rate for each of the plurality of wells relative to a pattern average water production rate.

5. The method for optimizing production of claim 1, wherein the production history includes at least one of a group consisting of a cumulative fluid production, a cumulative fluid injection, an oil cut, a water cut, an Oil Processing Ratio, a Voidage Replacement Ratio, and combinations thereof.

6. The method for optimizing production of claim 1, wherein the Oil Processing Ratio Strength Indicator is a measure of a preferential flow direction along at least one of the first orientation and the second orientation.

7. The method for optimizing production of claim 1, wherein the meta pattern is an area of the field that exhibits a bidirectional flow as determined by the Oil Processing Ratio Strength Indicator over more than one successive interval of the plurality of time intervals.

8. The method for optimizing production of claim 1, wherein the oilfield operation includes at least one operation from a group consisting of infill development, recompletion, stimulation, and combinations thereof.

9. A non-transitory computer storage medium having a computer program product stored thereon for optimizing production for a drilling operation in a field, the computer program product when executed causing a computer processor to:

identify a production history and an injection history for the plurality of wells;

determine a heterogeneity index value to each of the plurality of wells;

determine a pattern personality for each of the plurality of wells in response to determining the heterogeneity index value to each of the plurality of wells;

subdivide the production history and the injection history for the plurality of wells into a plurality of time intervals;

determine at least two domains for each of the plurality of wells wherein each of the at least two domains for each of the plurality of wells are centered around each of the plurality wells, wherein a first domain of the at least two domains has a first orientation, and wherein a second domain of the at least two domains has a second orientation;

determine an Oil Processing Ratio Strength Indicator for each of the at least two domains;

determine at least one meta pattern within the field in response to determining an Oil Processing Ratio Strength Indicator for each of the at least two domains; and guide an oilfield operation based on the pattern personality for each of the plurality of wells and the at least one meta pattern in response to determining the pattern personality for each of the plurality of wells and to determining the at least one meta pattern.

10. The non-transitory computer storage medium of claim 9, wherein the heterogeneity index value is a quantitative comparison of production performance, injection performance, or combinations thereof, based on the production history and the injection history for the plurality of wells, and wherein each of the wells is located within at least one pattern inside the field, each of the at least one patterns including at least one of the plurality of wells.

11. The non-transitory computer storage medium of claim 9, wherein the pattern personality for each of the plurality of wells is determined from at least one of an injection rate for each of the plurality of wells relative to a pattern average injection rate and production rate for each of the plurality of wells relative to a pattern average production rate.

12. The non-transitory computer storage medium of claim 11, wherein the pattern personality for each of the plurality of wells is determined from a water injection rate for each of the plurality of wells relative to a pattern average water injection rate, an oil production for each of the plurality of wells relative to a pattern average oil production rate, and a water production rate for each of the plurality of wells relative to a pattern average water production rate.

13. The non-transitory computer storage medium of claim 9, wherein the production history includes at least one of a group consisting of a cumulative fluid production, a cumulative fluid injection, an oil cut, a water cut, an Oil Processing Ratio, a Voidage Replacement Ratio, and combinations thereof.

14. The non-transitory computer storage medium of claim 9, wherein the Oil Processing Ratio Strength Indicator is a measure of a preferential flow direction along at least one of the first orientation and the second orientation.

15. The non-transitory computer storage medium of claim 9, wherein the meta pattern is an area of the field that exhibits a bidirectional flow as determined by the Oil Processing Ratio Strength Indicator over more than one successive interval of the plurality of time intervals.

16. The non-transitory computer storage medium of claim 9, wherein the oilfield operation includes at least one operation from a group consisting of infill development, recompletion, stimulation, and combinations thereof.

17. A method, implemented in a computer, for managing operations for an oilfield, the oilfield having a plurality of wells therein including a first wellsite comprising a producing well advanced into subterranean formations with geological structures and reservoirs therein, the producing well being for production of fluids from at least one reservoir in the reservoirs, wherein the plurality of wells further includes a second wellsite comprising an injection well advanced into the subterranean formations with the geological structures and the reservoirs, the injection well being therein for injection of fluids into the at least one reservoir, wherein the method comprises:

identifying a production history and an injection history for the plurality of wells;

determining a heterogeneity index value to each of the plurality of wells;

in response to determining the heterogeneity index value to each of the plurality of wells, determining a pattern personality for each of the plurality of wells;

subdividing the production history and the injection history for the plurality of wells into a plurality of time intervals;

determining at least two domains for each of the plurality of wells wherein each of the at least two domains for each of the plurality of wells are centered around each of the plurality wells, wherein a first domain of the at least two domains has a first orientation, and wherein a second domain of the at least two domains has a second orientation;

determining an Oil Processing Ratio Strength Indicator for each of the at least two domains;

in response to determining an Oil Processing Ratio Strength Indicator for each of the at least two domains, determining at least one meta pattern within the oilfield; and in response to determining the pattern personality for each of the plurality of wells and to determining the at least one meta pattern, guiding an oilfield operation based on the pattern personality for each of the plurality of wells and the at least one meta pattern.

18. The method of claim 17, wherein the heterogeneity index value is a quantitative comparison of production performance, injection performance, or combinations thereof, based on the production history and the injection history for the plurality of wells, and wherein each of the wells is located within at least one pattern inside the field, each of the at least one patterns including at least one of the plurality of wells.

19. The method of claim 17, wherein the pattern personality for each of the plurality of wells is determined from at least one of an injection rate for each of the plurality of wells relative to a pattern average injection rate and production rate for each of the plurality of wells relative to a pattern average production rate.

20. The method for managing operations of claim 19, wherein the pattern personality for each of the plurality of wells is determined from a water injection rate for each of the plurality of wells relative to a pattern average water injection rate, an oil production for each of the plurality of wells relative to a pattern average oil production rate, and a water production rate for each of the plurality of wells relative to a pattern average water production rate.

21. The method of claim 17, wherein the production history includes at least one of a group consisting of a cumulative fluid production, a cumulative fluid injection, an oil cut, a water cut, an Oil Processing Ratio, a Voidage Replacement Ratio, and combinations thereof.

22. The method claim 17, wherein the Oil Processing Ratio Strength Indicator is a measure of a preferential flow direction along at least one of the first orientation and the second orientation.

23. The method of claim 17, wherein the meta pattern is an area of the field that exhibits a bidirectional flow as determined by the Oil Processing Ratio Strength Indicator over more than one successive interval of the plurality of time intervals.

24. The method of claim 17, wherein the oilfield operation includes at least one operation from a group consisting of infill development, recompletion, stimulation, and combinations thereof.

* * * * *